US007605324B2

(12) United States Patent
Masuda et al.

(10) Patent No.: US 7,605,324 B2
(45) Date of Patent: Oct. 20, 2009

(54) APPARATUS FOR ASSISTING IN PLAYING MUSICAL INSTRUMENT

(75) Inventors: Hideyuki Masuda, Hamamatsu (JP); Junji Fujii, Hamamatsu (JP); Yutaka Tohgi, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 11/468,488

(22) Filed: Aug. 30, 2006

(65) Prior Publication Data

US 2007/0068372 A1 Mar. 29, 2007

(30) Foreign Application Priority Data

Aug. 30, 2005 (JP) ..... 2005-250017

(51) Int. Cl.
*G10H 3/00* (2006.01)
*G10H 1/06* (2006.01)
*G10H 1/46* (2006.01)

(52) U.S. Cl. ..... 84/723; 84/735; 84/741

(58) Field of Classification Search ..... 84/723, 84/729, 730, 732, 735, 741
See application file for complete search history.

(56) References Cited

U.S. PATENT DOCUMENTS

| | | | | |
|---|---|---|---|---|
| 2,001,723 | A * | 5/1935 | Hammond, Jr. | 84/723 |
| 3,571,480 | A * | 3/1971 | Tichenor et al. | 84/723 |
| 5,902,949 | A | 5/1999 | Mohrbacher | |
| 2005/0056139 | A1 | 3/2005 | Sakurada | |
| 2007/0017352 | A1 | 1/2007 | Masuda | |

FOREIGN PATENT DOCUMENTS

| | | | |
|---|---|---|---|
| EP | 1 748 416 | A1 | 1/2007 |
| FR | 2 704 968 | A1 | 11/1994 |
| FR | 2 775 823 | A1 | 9/1999 |
| JP | 2004-177828 | A | 6/2004 |
| JP | 2004-258443 | A | 9/2004 |

(Continued)

OTHER PUBLICATIONS

Atsuo Takanishi et al., "Development of an Anthropomorphic Flutist Robot WF-3RII", Intelligent Robots and Systems 1996, Proceedings of the 1996 LEEE/RSJ International Conference on Osaka, vol. 1, pp. 37-43, Japan, Nov. 4, 1996.

(Continued)

*Primary Examiner*—Lincoln Donovan
*Assistant Examiner*—Andrew R Millikin
(74) *Attorney, Agent, or Firm*—Rossi, Kimms & McDowell LLP

(57) ABSTRACT

An apparatus is to assist an unskilled player in playing a musical instrument by detecting the quantity of the player's manipulation against the instrument, modifying the detected manipulation quantity with reference to a recommended manipulation to a degree according to a given assistance coefficient, and actuating the instrument with the modified manipulation quantity. For a brass instrument, the apparatus comprises an embouchure sensor and a breath pressure sensor to detect the embouchure and the breath pressure of the player as he/she plays the brass instrument. The detected embouchure and breath pressure are then modified with reference to a recommended embouchure and breath pressure weighted by a given assistance coefficient. The apparatus actuates the brass instrument based on the modified embouchure and breath pressure.

7 Claims, 17 Drawing Sheets

Configuration of Assisting Apparatus

FOREIGN PATENT DOCUMENTS

JP 2004-314187 A 11/2004

OTHER PUBLICATIONS

Joel Gilbert et al., "Artificial Buzzing Lips and Brass Instruments: Experimental Results", Journal of the Acoustical Society of America, vol. 104, No. 3, pp. 1627-1632, Acoustical Society of America, Sep. 1998.

Relevant Portion of European Search Report issued in corresponding European Patent Application No. 06018130.2-2225, dated Apr. 2, 2007.

* cited by examiner

*Fig. 1* Configuration of Assisting Apparatus

*Fig.2* Circuit Diagram of Embouchure Modifying Unit

*Fig.3* Configuration of Assisting Apparatus

*Fig.4* Circuit Diagram of Embouchure Modifying Unit

*Fig.5* Configuration of Assisting Apparatus

Front View around Mouthpiece and Lips

Fig. 7 Configuration of Assisting Apparatus

*Fig. 8* Configuration of Assisting Apparatus

*Fig.9* Configuration of Assisting Apparatus

*Fig. 10* Configuration of Assisting Apparatus

*Fig. 11* Configuration of Assisting Apparatus

Configuration of Assisting Apparatus

Configuration of Assisting Apparatus

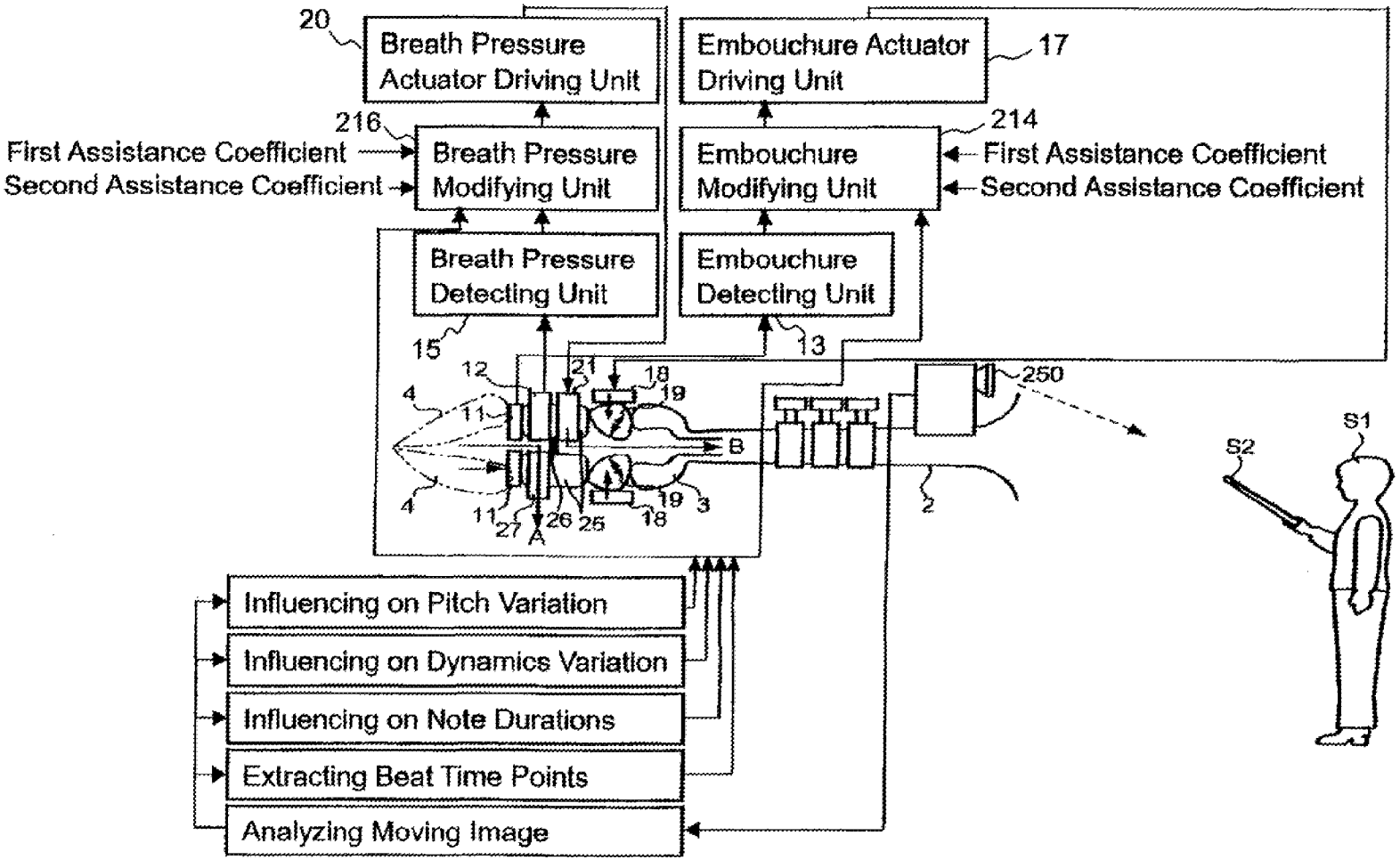
*Fig. 14* Configuration of Assisting Apparatus

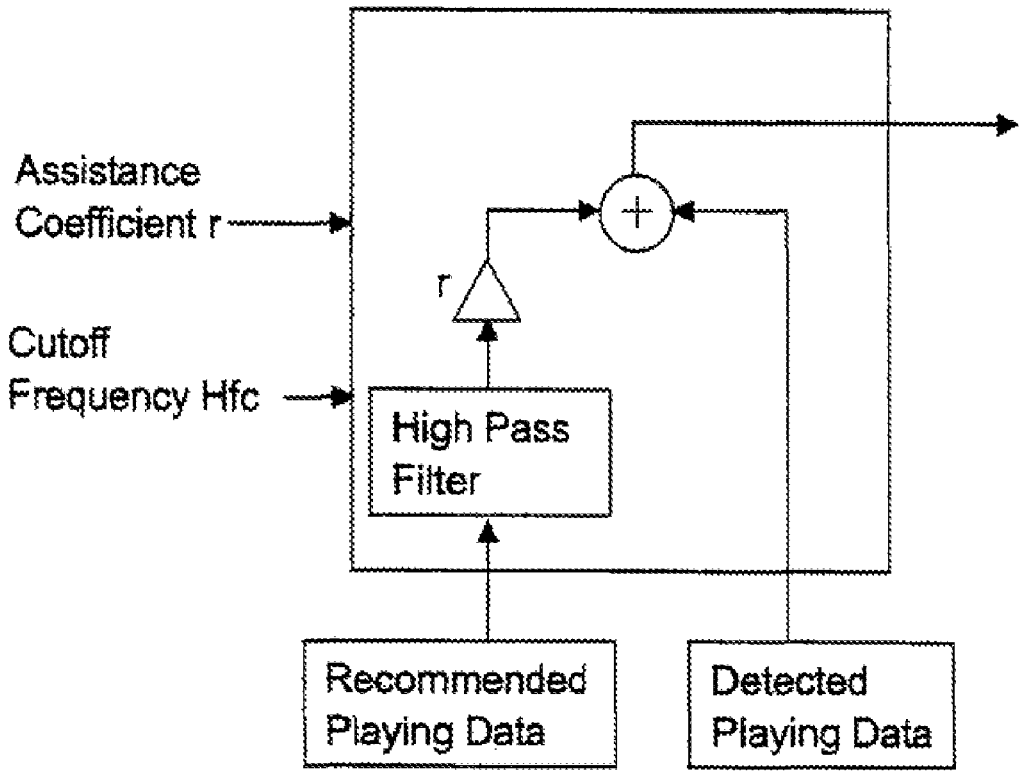
*Fig.15* Circuit Diagram of Modifying Unit and Data Processing

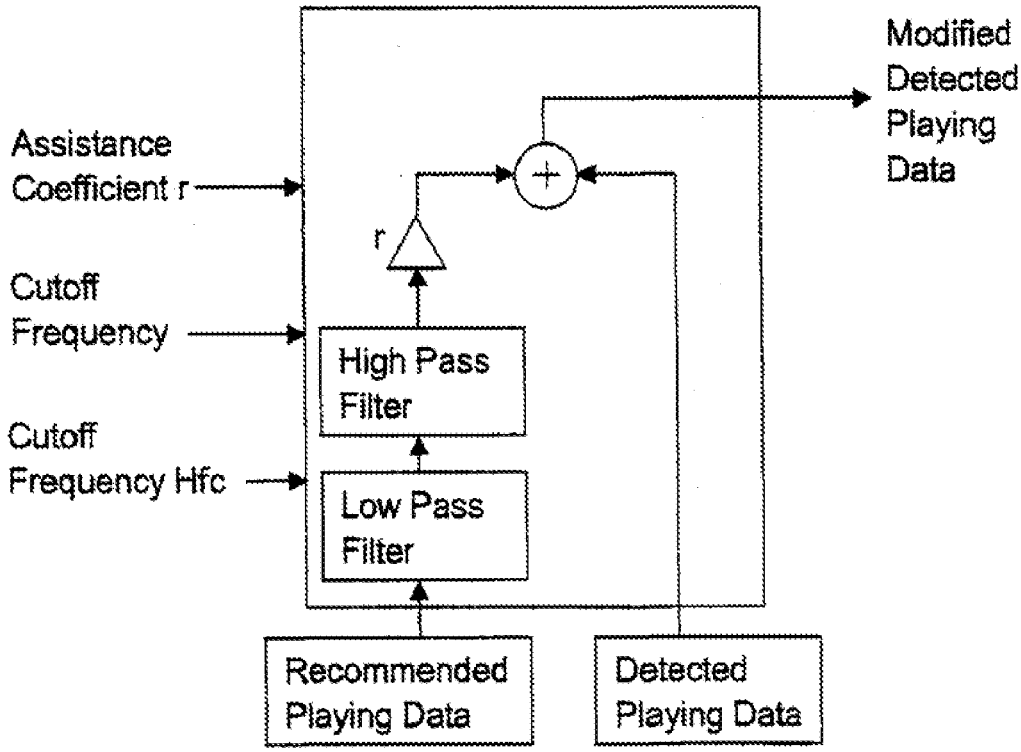
*Fig.16* Circuit Diagram of Modifying Unit and Data Processing

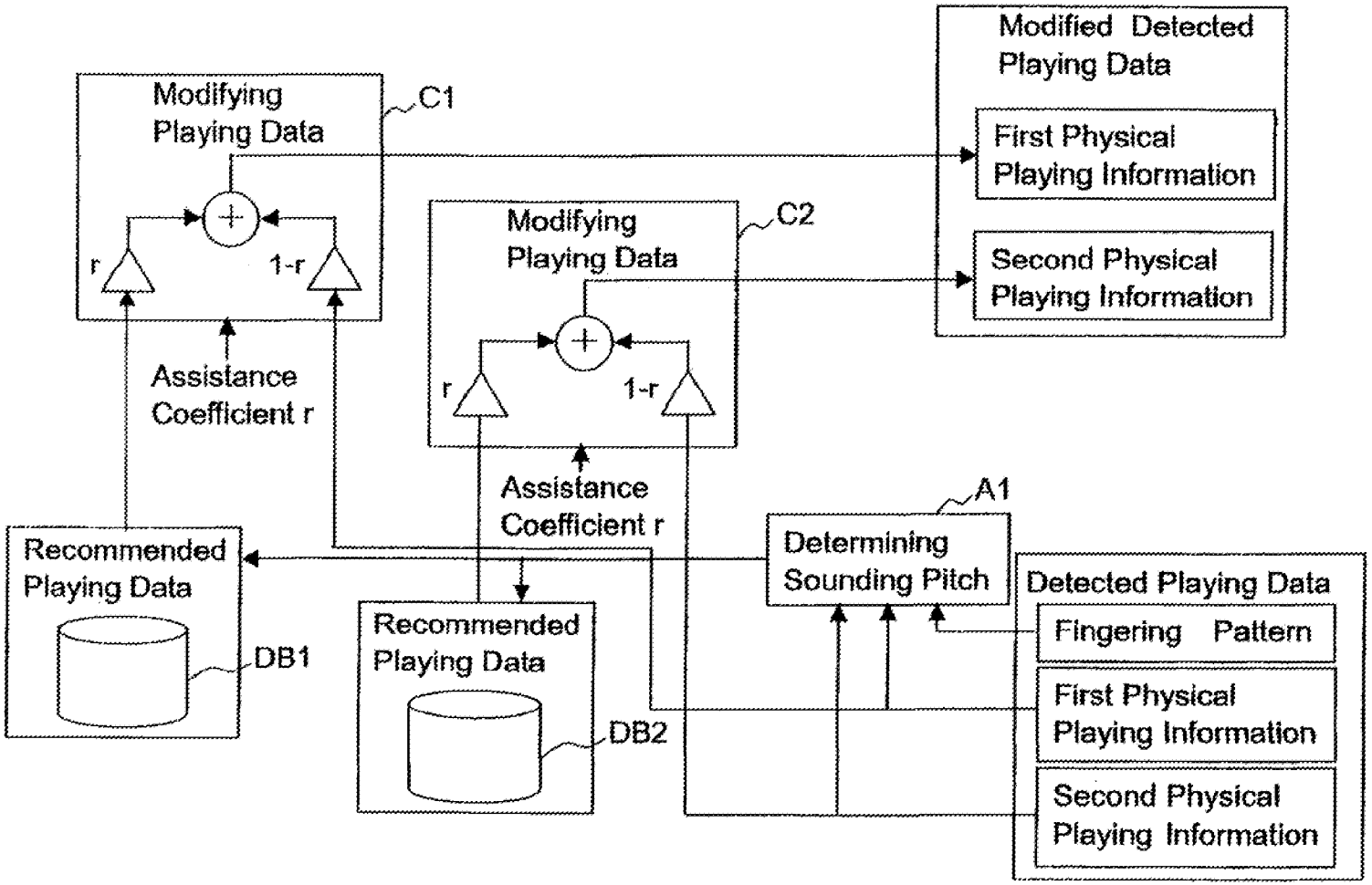
*Fig. 17* Circuit Diagram of Modifying Unit and Data Processing

APPARATUS FOR ASSISTING IN PLAYING MUSICAL INSTRUMENT

TECHNICAL FIELD

The present invention relates to an apparatus for assisting a player in playing a musical instrument, and more particularly to an assisting apparatus to be operatively coupled both to the player and to the musical instrument so that even an unskilled player can exert manipulations on the assisting apparatus as if on the instrument and the assisting apparatus in turn will actuate the instrument with more skilled manipulations in place of the player.

BACKGROUND INFORMATION

Machines which play a musical instrument automatically are widely known in the art. For example, player pianos and player organs which play music automatically have been manufactured from long ago. In recent years, there have been developed not only machines which play the keyboard musical instrument but also machines which play the wind musical instrument automatically. For example, unexamined Japanese patent publications No. 2004-258443, No. 2004-177828 and No. 2004-314187 disclose robots which play the brass musical instrument automatically.

However, such a conventional player piano and player organ, and the robots disclosed in the above-listed patent publications are machines which give an entire musical performance automatically while the user simply listen to the performed music. On the other hand, there are many people who would like to play the musical instrument according to their own manipulations against the musical instrument. The above-mentioned conventional automatic music playing machines, however, cannot meet their wishes to play the musical instrument by themselves.

SUMMARY OF THE INVENTION

In view of the foregoing background, therefore, it is a primary object of the present invention to provide an apparatus for assisting the player in playing the musical instrument so that even an unskilled player can play the musical instrument in a better performance according to his/her own manipulation against the musical instrument.

According to the present invention, the object is accomplished by providing an apparatus for assisting in playing a musical instrument comprising: a manipulation quantity detecting device for detecting a quantity of manipulation by a player against a musical instrument for playing the musical instrument; an assistance signal generating device for generating an assistance signal which represents a degree of assistance in playing the musical instrument by processing the detected quantity of manipulation according to a given assistance coefficient; and an actuating device adapted to be coupled to the musical instrument for actuating the musical instrument based on the assistance signal.

In an aspect of the present invention, the musical instrument can be a brass instrument having a mouthpiece; and the actuating device may include artificial lips having a plurality of elastic (flexible) members covering the mouthpiece, an actuator for actuating the artificial lips based on the assistance signal to establish an embouchure for playing the brass instrument and a gas blowing mechanism for blowing compressed gas into the mouthpiece through the artificial lips, wherein the artificial lips and the gas blowing mechanism may be controlled based on the assistance signal to determine an amount of the blown compressed gas. The manipulation quantity detecting device may include a sensor attached to the mouthpiece to which the player presses his/her lips and blows in a breath, the sensor detecting an embouchure of the player against the mouthpiece, and the quantity of manipulation including the embouchure. The manipulation quantity detecting device may include a breath pressure sensor attached to the mouthpiece to which the player presses his/her lips and blows in a breath, the sensor detecting a breath pressure of the player, and the quantity of manipulation including the breath pressure. The actuating device may include a vibrator attached to the mouthpiece and driven by the assistance signal. Thus, the player is to manipulate the manipulation quantity detecting device as if the player were blowing the brass instrument, and the actuating device will actuate the brass instrument in place of the player.

In another aspect of the present invention, the musical instrument can be a wood wind instrument having a mouthpiece with a reed attached thereto, and the actuating device may include a vibrator coupled to the reed and driven by the assistance signal. The musical instrument can also be a wood wind instrument of an air reed type having a blow hole, and the manipulation quantity detecting device may include a sensor attached to the blow hole for detecting a jet velocity, a jet length and a jet width of the air blown by the player, the quantity of manipulation including the jet velocity, the jet length and the jet width to be detected by the sensor, and the actuating device may include a vibrator coupled to the blow hole and driven by the assistance signal. Thus, the player is to manipulate the manipulation quantity detecting device as if the player were blowing the wood wind instrument, and the actuating device will actuate the wood wind instrument in place of the player.

According to the present invention, the object is further accomplished by providing an apparatus for assisting in playing a musical instrument comprising: a manipulation quantity detecting device for detecting a quantity of manipulation by a player against a musical instrument for playing the musical instrument, the quantity of manipulation representing a magnitude of physical quantity exerted by the player; an assistance signal generating device for generating an assistance signal which represents a degree of assistance in playing the musical instrument by processing the detected quantity of manipulation according to a given assistance coefficient; and a physical quantity increasing device attached to the player for increasing the magnitude of physical quantity exerted in playing the musical instrument based on the assistance signal.

In still another aspect of the present invention, the physical quantity increasing device may include a compressed gas introducing device for introducing compressed gas into a mouth cavity of the player with the quantity of the gas being controlled based on the assistance signal. The physical quantity increasing device may be coupled to the player at a body portion which is moved to play the musical instrument and may increase a force in the direction in which the body portion is moved for playing the musical instrument.

In a further aspect of the present invention, the musical instrument can be a keyboard type instrument having keys for playing musical notes, and the actuating device may include a key actuating device which actuates the keys, and the physical quantity increasing device controls the key actuating device to energize the keys in the direction in which the player manipulates the keys based on the assistance signal.

In a still further aspect of the present invention, the apparatus for assisting a musical instrument may comprise a first manipulation quantity detecting device for detecting a first quantity of manipulation by a first player against a first musical instrument for playing the first musical instrument and a second manipulation quantity detecting device for detecting a second quantity of manipulation by a second player against a second musical instrument for playing the second musical instrument, and the assistance signal generating device for generating the assistance signal by processing the first quantity of manipulation detected by the first manipulation quantity detecting device and the second quantity of manipulation detected by the second manipulation quantity detecting device, respectively, according to respectively given assistance coefficients.

In a still further aspect of the present invention, the apparatus for assisting in playing a musical instrument may further comprise: a manipulation condition detecting sensor for detecting conditions of manipulating elements of the musical instrument, and a pitch determining device which determines a sounding pitch of the musical instrument based on the detected conditions of the manipulating elements the actuating device actuating the musical instrument based on the assistance signal and the determined sounding pitch.

With the apparatus for assisting in playing a musical instrument, the assistance signal is generated automatically by processing the detected quantity of manipulation by the player and the actuating device actuates, namely, play the musical instrument in place of the player based on the assistance signal, and therefore a surrogate play of the musical instrument will be realized in good accordance with the player's manipulation against the musical instrument. Further, with the apparatus for assisting in playing a musical instrument, the assistance signal is generated automatically by processing the detected quantity of manipulation by the player and the physical quantity increasing device increases the magnitude of physical quantity exerted by the player in playing the musical instrument based on the assistance signal, and therefore a surrogate play of the musical instrument will be realized with sufficient strength, even where the manipulating force of the player may be insufficient.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described bellow.

BRIEF DESCRIPTION OF THE DRAWINGS

For a better understanding of the present invention, and to show how the same may be practiced and will work, reference will now be made, by way of example, to the accompanying drawings, in which:

FIG. 14 is a block diagram illustrating the overall configuration of an apparatus for assisting in playing a musical instrument incorporating an additional function according to an embodiment of the present invention;

FIG. 15 is a circuit diagram illustrating an example of the modifying unit and the data processing employed in an apparatus for assisting in playing a musical instrument according to the present invention;

FIG. 16 is a circuit diagram illustrating a further example of the modifying unit and the data processing employed in an apparatus for assisting in playing a musical instrument according to the present invention; and FIG. 17 is a circuit diagram illustrating a still further example of the modifying unit and the data processing employed in an apparatus for assisting in playing a musical instrument according to the present invention.

DETAILED DESCRIPTION OF EMBODIMENTS OF THE INVENTION

The present invention will now be described in detail with reference to the drawings showing preferred embodiments thereof. It should, however, be understood that the illustrated embodiments are merely examples for the purpose of understanding the invention, and should not be taken as limiting the scope of the invention.

First Embodiment

Figure 1:
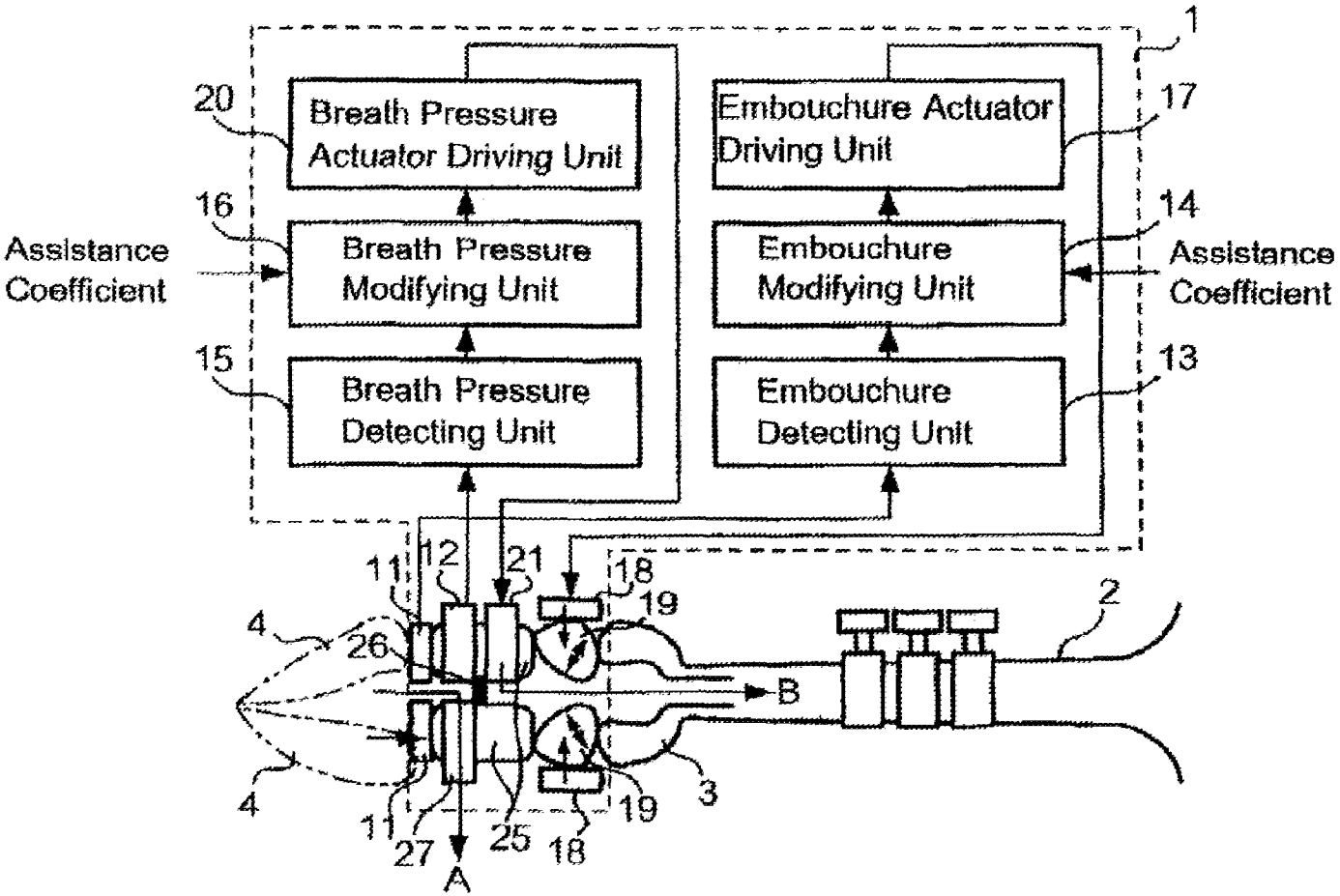
FIG. 1 is a block diagram illustrating the overall configuration of an apparatus for assisting in playing a musical instrument according to an embodiment of the present invention.

FIG. 1 shows a block diagram illustrating the overall configuration of an apparatus for assisting in playing a musical instrument according to a first embodiment of the present invention. The apparatus for assisting in playing a musical instrument is demarcated by the dash-single-dot line 1, and the musical instrument is a trumpet 2 partially shown in the Figure. The numeral 3 denotes a mouthpiece attached to the trumpet 2, and the two numerals 4 denote the lips of the player of the trumpet in dash-double-dot lines.

In FIG. 1, the numeral 11 denotes an embouchure detecting sensor which detects the physical conditions (usually referred to as "embouchure") relating to the player's lip structure or posture, for example, the stiffness (tension) and the aperture (opening) size of the player's lips, and generates a signal (information) representing such a physical condition.

An example of specific method for computing (numerically representing) the aperture and the stiffness will be described herein below. The aperture can be determined by setting a light sensor on the surface of the embouchure detecting sensor 11 which contacts the lips 4, and computing from the detected values. The quantity of light detected by the light sensor varies in accordance with the opening area of the player's lips. The embouchure detecting unit 13 computes the aperture (size and/or shape) based on the information representing the quantity of light detected by the light sensor.

As the stiffness is the degree of tension of the muscle around the mouth (orbicular muscle of mouth), it is difficult to directly detect the stiffness itself. However, considering states in which lips are pressed on to a flat plate, it is experientially evident that where the lips are pressed on to the flat plate with a small pressure, the contact area of the lips with the flat plate will be rather large when the lips are loosened, and the contact area will become smaller as the lips are tensioned stronger, and further that where the lips are kept tensioned with a certain strength, the contact area will become larger as the lips are pressed stronger.

In accordance with the above explained principles, the embouchure detecting sensor 11 includes a contact area sensor and a pressure sensor so that the stiffness will be computed (obtained) from the detected values of these sensors according to an appropriate algorithm. The contact area sensor is formed in a plane plate so that the contact area is detected as the lips 4 of the player contact the front surface of the plane plate, and the contact area sensor outputs the detected contact area. The pressure sensor is provided on the rear surface of the plane plate so that the pressing strength is detected as the lips 4 of the player press the plane plate, which in turn presses the pressure sensor, and the pressure sensor outputs a signal representing the detected pressure.

The numeral 13 denotes an embouchure detecting unit which generates an embouchure signal (physical information) representing the physical conditions of the player's lips based on the output of the embouchure detecting sensor 11, i.e. by converting the output of the embouchure detecting sensor 11 to the embouchure signal using a mathematical function or a table stored in therein beforehand. The numeral 14 denotes an embouchure modifying unit which generates an embouchure assistance signal by modifying the embouchure signal supplied from the embouchure detecting unit 13.

Figure 2:
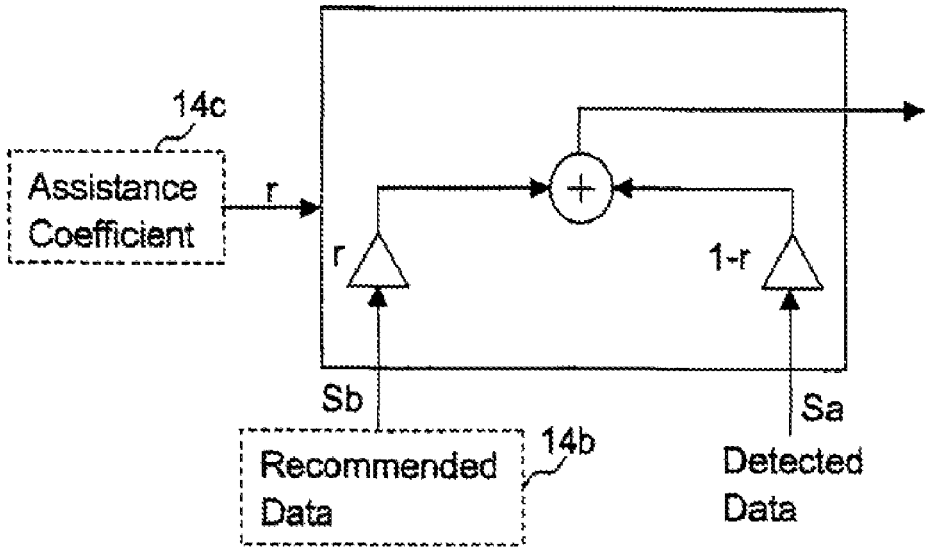
FIG. 2 is a circuit diagram illustrating an example of the embouchure modifying unit shown in FIG. 1.

FIG. 2 is a circuit diagram illustrating a circuit configuration of an example of the embouchure modifying unit 14. The reference symbol Sa denotes a detected data which is the above mentioned embouchure signal from the embouchure detecting unit 13, and the reference symbol Sb denotes the recommended data for the skilled playing which is set in the assisting apparatus 1 beforehand. The recommended data Sb is the data representing a recommended value for playing the instrument, and may be a fixed value initially set in the apparatus 1 or may be a value which can be varied properly. The reference symbol r denotes an assistance coefficient which is set in the assisting apparatus 1 beforehand and represents the degree of assistance toward a better playing. As will be understood from the circuit diagram, the embouchure modifying unit 14 processes the embouchure signal Sa and the recommended data according to the assistance coefficient r, and generates an embouchure assistance signal which represents the content of assistance in playing the musical instrument. The assistance coefficient r is a parameter having a value in the range of $0=<r<=1$, and may be a fixed value initially set in the apparatus 1 or bay be a value which can be varied properly. More specifically, the embouchure modifying unit 14 conducts a mathematical operation of "$Sa\times(1-r)+Sb\times r$" and outputs the operation result as the embouchure assistance signal. In the formula, the symbol "×" means the multiplication sign.

The numeral 12 denotes a breath pressure detecting sensor for detecting the breath pressure of the player and generating a signal which represents the breath pressure. The expired gas from the player flows in the direction of an arrow A, and its breath pressure is detected by the breath pressure detecting sensor 12. The flow path of the expired gas will be described in detail herein later. The reference numeral 15 denotes a breath pressure detecting unit which generates a breath pressure signal based on the output from the breath pressure detecting sensor 12. The numeral 16 denotes a breath pressure modifying unit which generates a breath pressure assistance signal based on the breath pressure signal supplied from the breath pressure detecting unit 15. The circuit configuration of the breath pressure modifying unit 16 and the method of generating the breath pressure assistance signal are the same as those shown in FIG. 2 for the embouchure modifying unit 14, and the detailed description is omitted herein.

The numeral 17 denotes an embouchure actuator driving unit and the numeral 18 denotes an embouchure actuator. The embouchure actuator driving unit 17 drives the embouchure actuator 18 based on the embouchure assistance signal supplied from the embouchure modifying unit 14. The numeral 19 denotes artificial lips made of an elastic (flexible) material such as rubber and plastic. The artificial lips 19 are fixed to a part of the mouthpiece 3 to which the player's lips would be pressed for playing the trumpet 2 by means of an appropriate fixing member (not shown). The embouchure actuators 18 are provided in contact with the artificial lips 19 from above and bellow so that the pressing strength and direction against the artificial lips 19 are varied under the control by the embouchure actuator driving unit 17 to control the stiffness and the aperture size of the artificial lips 19. The embouchure actuator 18 are provided as a combination of plural elements such as electromagnetic actuators and piezoelectric actuators surrounding the artificial lips 19.

The numeral 20 in FIG. 1 denotes a breath pressure actuator driver unit and the numeral 21 denotes a breath pressure actuator for flowing air having a breath pressure into the trumpet 2. The breath pressure actuator 21 comprises an air tank (not shown) which flows out compressed air. The breath pressure actuator driving unit 20 drives the breath pressure actuator 21 based on the breath pressure assistance signal supplied from the breath pressure modifying unit 16 to regulate the flow rate of the compressed air. The numeral 25 denotes a tubular supporting member which is attached to the mouthpiece 3 together with the artificial lips axially aligned with the bore of the trumpet 2. A fixing member to fix the supporting member 25 to the trumpet 2 is omitted from the Figure. A partition wall 26 is provided at the central portion of the supporting member 25 to separate the front part and the rear part of the bore. Thus, the rear part of the bore of the supporting member 25 and the inner space surrounded by the artificial lips 19 are connecting with the bore path of the trumpet 2, but are kept airtight from the remaining environment. The breath pressure actuator 21 is provided to penetrate the upper tubular wall of the supporting member in the rear part thereof so that the air blown out from the breath pressure actuator 21 flows through the artificial lips 19 and then the mouthpiece 3 into the bore of the trumpet 2 as shown by an arrow B in the Figure.

The breath pressure sensor 12 is provided to penetrate the upper tubular wall of the supporting member 25 in the front part thereof to expose in the front bore of the supporting member 25. An air passage member 27 is provided through the lower tubular wall of the supporting member 25 in the front part thereof to provide a passage for the expired gas flowing out in the direction shown by an arrow A in the Figure. The embouchure detecting sensor 11 is formed in a ring shape and is fixed to the front face of the supporting member 25. The embouchure detecting sensor 11 has a similar shape as the cup of the prevailing mouthpiece so that the player can blow air into the central aperture of the embouchure detecting sensor 11 as if the player were pressing his/her lips on to the mouthpiece.

The embodiment of the above described arrangement will operate as follows. As the player presses his/her lips 4 against the embouchure detecting sensor 11 and forms a lip reed to blow air into the supporting member 25, the embouchure condition and the breath pressure are detected by the embouchure detecting sensor 11 and the breath pressure detecting sensor 12, respectively. On one hand the breath pressure detecting unit 15 detects the breath pressure, and the breath pressure modifying unit 16 then generates the breath pressure assistance signal by adding the recommended breath pressure data in an amount corresponding to the assistance coefficient r. The breath pressure actuator driving unit 20 drives the breath pressure actuator 21 in accordance with the breath pressure assistance signal so that the compressed air will flow into the bore of the trumpet 2 in a quantity determined by the breath pressure assistance signal. On the other hand, the embouchure detecting unit 13 detects the embouchure condition of the player, and the embouchure modifying unit 14 then generates the embouchure assistance signal by incorporating the recommended embouchure data Sb in an amount corresponding to the assistance coefficient r. The embouchure actuator driving unit 17 drives the embouchure actuator 18 in accordance with the embouchure assistance signal so that the artificial lips 19 establishes an embouchure condition in connection with the mouthpiece 3 as determined by the embouchure assistance signal. As a result of the above described operation, the trumpet 2 produces a tone as determined by the embouchure condition of the artificial lips 19 and the air flow supplied from the breath pressure actuator 21. The produced tone is the outcome of the triggering by the lip reed formed by the artificial lips 19 and the resonance of air column in the bore path of the trumpet 2.

While a skilled player can adequately control the stiffness (tension) and the aperture of the lips to produce any pitches of tones easily, an unskilled player such as a beginner and an intermediate learner can neither establish a sufficient stiffness of the lips nor control the size and the shape of the lip aperture, and consequently cannot produce tones of a wide pitch range at will. Especially the tones in a high pitch (high frequency) range are difficult to produce, as those tones would require the player to keep the size of the lip aperture small. According to this first embodiment of the present invention, as the beginner or the intermediate learner controls his/her lips to a certain degree within his/her skill, the embouchure detecting sensor 11 detects such an embouchure of the player, and the embouchure modifying unit 14 generates an embouchure assistance signal based on the detected embouchure to thereby control the stiffness and the aperture of the artificial lips 19. Thus, even an unskilled player can produce tones of any pitches easily and accurately, especially high pitched tones without difficulty.

Further, the beginner and the intermediate learner would usually be not good at blowing air with a high breath pressure and accordingly producing tones of great volume. With this embodiment, however, even though the player is actually blowing a small amount of air, the assisting apparatus will generate a breath pressure assisting signal based on the detected breath pressure of the player and increase the pressure of the air flowing into the mouthpiece to blow a large amount of air into the trumpet 2. This will enables even an unskilled player to play the trumpet in great tone volume easily. Further, this will contribute to stabilize the pitch of the played tone by stabilizing the air pressure blown into the mouthpiece.

As will be apparent from the above explanation about this embodiment, the influence of the recommended data will be larger as the value of the assistance coefficient r used in the embouchure modifying unit 14 and the breath pressure modifying unit 16 is larger, and vice versa. In other words, as the value of the assistance coefficient r is smaller, the trumpet 2 will produce tones which is closer to the actual tones as played by the player. Accordingly, the assistance coefficient r would preferably be set at a larger value for the beginners, and as the skill goes higher the value of the assistance coefficient r would be decreased gradually, which will expedite a smooth progress of the player's skill.

In this connection, it will be beneficial to provide an assistance coefficient setting unit 14*c* as shown by broken lines in FIG. 2 so that the player can arbitrarily set the value of the assistance coefficient r by manipulating the adjuster. Further, a recommended data generating unit 14*b* may be provided as shown by broken lines in FIG. 2 so that the recommended values of the embouchure condition and the breath pressure can be determined based on the detected player's embouchure condition and/or breath pressure with reference to a table or a mathematical function stored therein. With such a configuration, the recommended data will be generated in accordance with the playing conditions of the player in real time, which will allow the generation of recommended data which meet the playing skill of the player.

Second Embodiment

Figure 3:
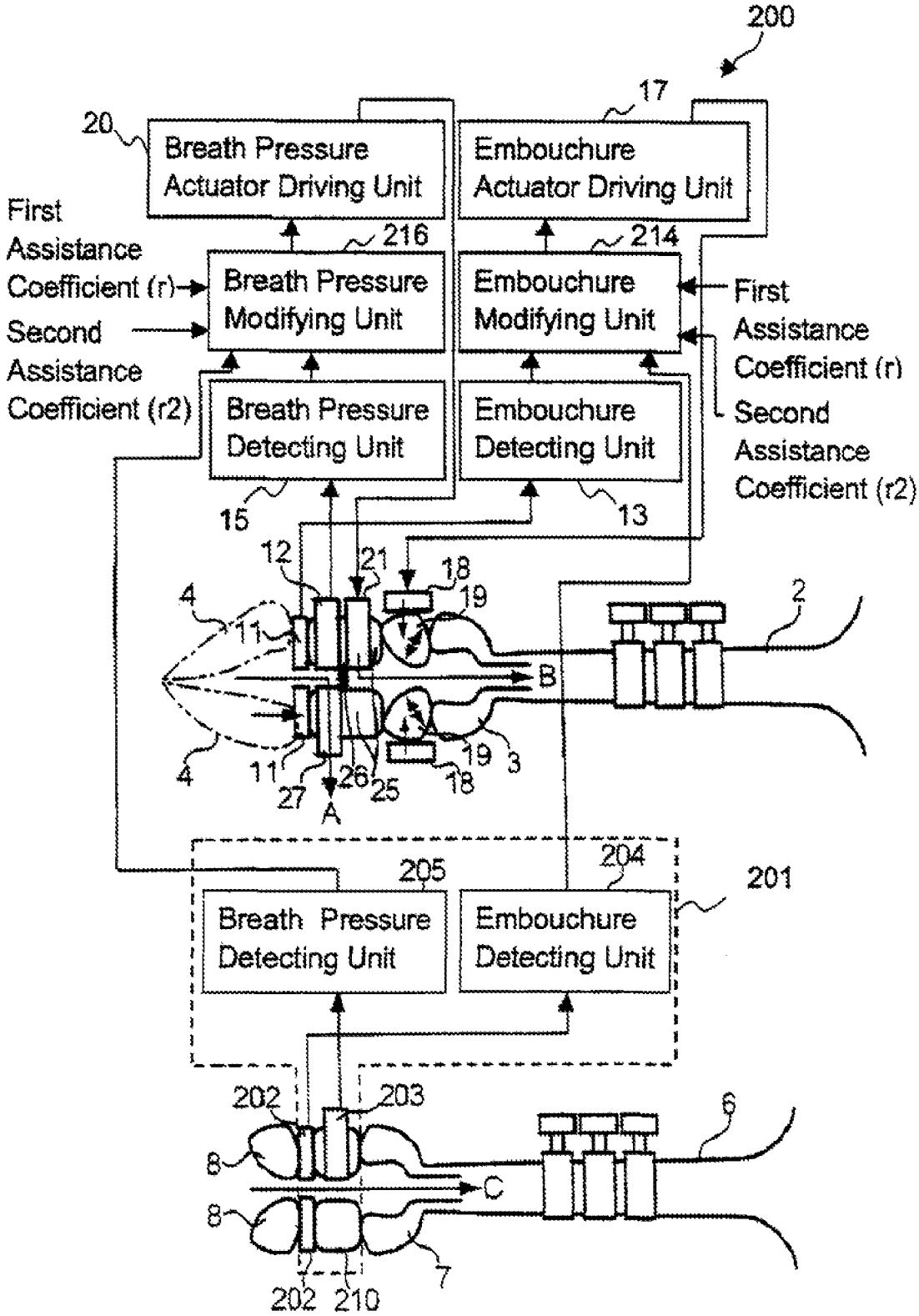
FIG. 3 is a block diagram illustrating the overall configuration of an apparatus for assisting in playing a musical instrument according to another embodiment of the present invention.

Herein-below will be described a second embodiment of the present invention. FIG. 3 shows a block diagram illustrating the overall configuration of an apparatus for assisting in playing a musical instrument according to the second embodiment of the present invention, as is generally referenced by the numeral 200. The assisting apparatus 200 is different from the assisting apparatus 1 of the first embodiment in the point that the second embodiment comprises a model playing condition detecting unit 201 as demarcated by the broken lines for detecting the breath pressure and the embouchure condition of another player, i.e. a model player, and in the point that the processing in the breath pressure modifying unit 216 and in the embouchure modifying unit 214 are different from that in the first embodiment. The remaining parts are the same as those in the first embodiment. In the following description, therefore, those points which are different from the first embodiment will be mainly explained, and the explanation about the same or similar parts will be omitted by putting the same or similar reference numerals or symbols as those in the first embodiment.

In FIG. 3, the numeral 6 denotes a trumpet played by another player, i.e. a second player, and 7 a mouthpiece attached to the trumpet 7. The numeral 8 denotes the lips of the second player. In this second embodiment, the trumpet 2 is played by the first player (e.g. an unskilled player) and the trumpet 6 is played by the second player (e.g. a skilled player). The second player is a player who gives the model playing.

The numeral 210 denotes a tubular supporting member fixed to the trumpet 6 axially aligned with the bore of the trumpet 6. Penetrating the upper wall of the supporting member 210 is provided a breath pressure sensor 203 which detects the breath pressure of the second player and generates a signal representing the detected breath pressure. The numeral 202 denotes an embouchure detecting sensor which generates a signal representing the embouchure of the player's lips 8 and is formed similarly as the embouchure sensor 11 of FIG. 1. As the exhalation or expired air from the second player flows in the direction shown by an arrow C in the Figure, a breath pressure sensor 203 detects the breath pressure of the air flow. The numeral 204 denotes an embouchure detecting unit which generates an embouchure signal based on the output signal from the embouchure detecting sensor 202. The embouchure detecting unit 204 supplies the generated embouchure signal to an embouchure modifying unit 214. The method of obtaining the embouchure is the same as described in connection with the first embodiment, and the detailed description is omitted here. The numeral 205 denotes a breath pressure detecting unit which generates a breath pressure signal based on the output from the breath pressure sensor 203. The breath pressure detecting unit 205 supplies the generated breath pressure signal to a breath pressure modifying unit 216.

Figure 4:
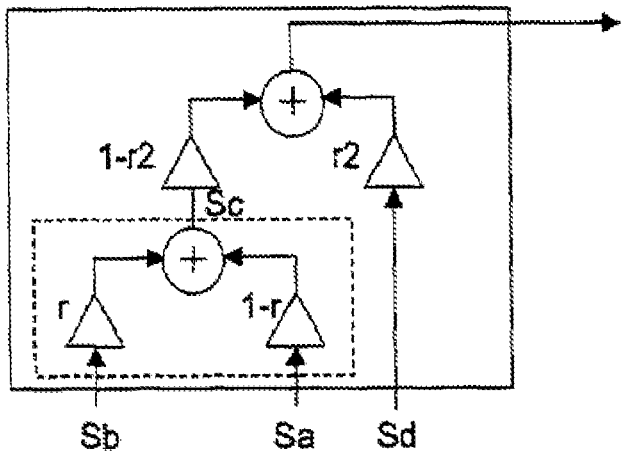
FIG. 4 is a circuit diagram illustrating an example of the embouchure modifying unit shown in FIG. 3.

FIG. 4 is a circuit diagram illustrating an example of the electric circuit of the embouchure modifying unit 214. The part surrounded by broken lines in FIG. 4 is the same as that shown in FIG. 2 in connection with the first embodiment. In FIG. 4, the symbol Sc denotes a generated signal which is synthesized from the embouchure signal Sa, a recommended data signal Sb and the assistance coefficient r. The reference symbol Sd denotes an embouchure signal supplied from the embouchure detecting unit 204. The reference symbol r2 denotes an assistance coefficient stored in the assisting apparatus 200 beforehand. As shown in FIG. 4, the embouchure modifying unit 214 conducts a mathematical operation of "$Sc\times(1-r2)+Sd\times r2$" and outputs the operation result as the embouchure assistance signal.

The breath pressure modifying unit 216 is also of a same electric structure as is shown in FIG. 4, and generate a breath pressure assistance signal from the breath pressure signal supplied from the breath pressure detecting unit 15, the breath pressure signal supplied from the breath pressure detecting unit 205, and the assistance coefficients r and r2.

The second embodiment of the above described arrangement will operate as follows. As the first player presses his/her lips 4 against the embouchure detecting sensor 11 and forms a lip reed to blow air into the supporting member 25, the embouchure condition and the breath pressure are detected by the embouchure detecting sensor 11 and the breath pressure detecting sensor 12, respectively. And simultaneously therewith, as the second player presses his/her lips 8 against the embouchure detecting sensor 202 and forms a lip reed to blow air into the mouthpiece 7 through the supporting member 210, the embouchure condition and the breath pressure are detected by the embouchure detecting sensor 202 and the breath pressure detecting sensor 203, respectively. The breath pressure detecting sensor 15 and the breath pressure detecting sensor 205 detect the breath pressures of the first player and the second player, respectively, and the breath pressure modifying unit 216 generates the breath pressure assistance signal by incorporating both the recommended breath pressure data in an amount corresponding to the assistance coefficient r and the breath pressure information from the second player in an amount corresponding to the assistance coefficient r2. The breath pressure actuator driving unit 20 drives the breath pressure actuator 21 in accordance with the breath pressure assistance signal so that the compressed air will flow into the bore of the trumpet 2 in a quantity determined by the breath pressure assistance signal.

On the other hand, the embouchure detecting unit 13 and the embouchure detecting unit 204 detect the embouchure conditions of the first player and the second player, respectively, and the embouchure modifying unit 214 generates the embouchure assistance signal by incorporating the recommended data Sb in an amount corresponding to the assistance coefficient r and the embouchure data Sd of the second player in an amount corresponding to the assistance coefficient r2. The embouchure actuator driving unit 17 drives the embouchure actuator 18 in accordance with the embouchure assistance signal so that the artificial lips 19 establishes an embouchure condition in connection with the mouthpiece 3 as determined by the embouchure assistance signal. As a result of the above described operation, the trumpet 2 produces a tone as determined by the embouchure condition of the artificial lips 19 and the air flow supplied from the breath pressure actuator 21.

Thus, the second embodiment assists the player in playing the trumpet both by using the recommended data Sa and the first assistance coefficient r as in the case of the first embodiment and by using the breath pressure and the embouchure (hereinafter collectively referred to as "physical information") of the second player and the second assistance coefficient r2. As will be understood from FIG. 4, the assisting apparatus 200 operates in such a way that the effect of modifying the physical information using the first assistance coefficient r and the effect of modifying the physical information using the second assistance coefficient r2 take place simultaneously. For example, if the second assistance coefficient r2 is set at zero and the first assistance coefficient r is set at a substantial value, the system operates in the same way as the first embodiment. To the contrary, if the first assistance coefficient r is set at zero and the second assistance coefficient r2 is set at a substantial value, the system works under the influence of the second player. The first and the second assistance coefficient r and r2 can be set arbitrarily at any intermediate condition of the above two conditions so that the intermediate control will be realized. The second embodiment is advantageous in that the first player (e.g. a student) can be assisted in playing the trumpet using the physical information from the model playing by the second player (e.g. an instructor or teacher).

Third Embodiment

Figure 5:
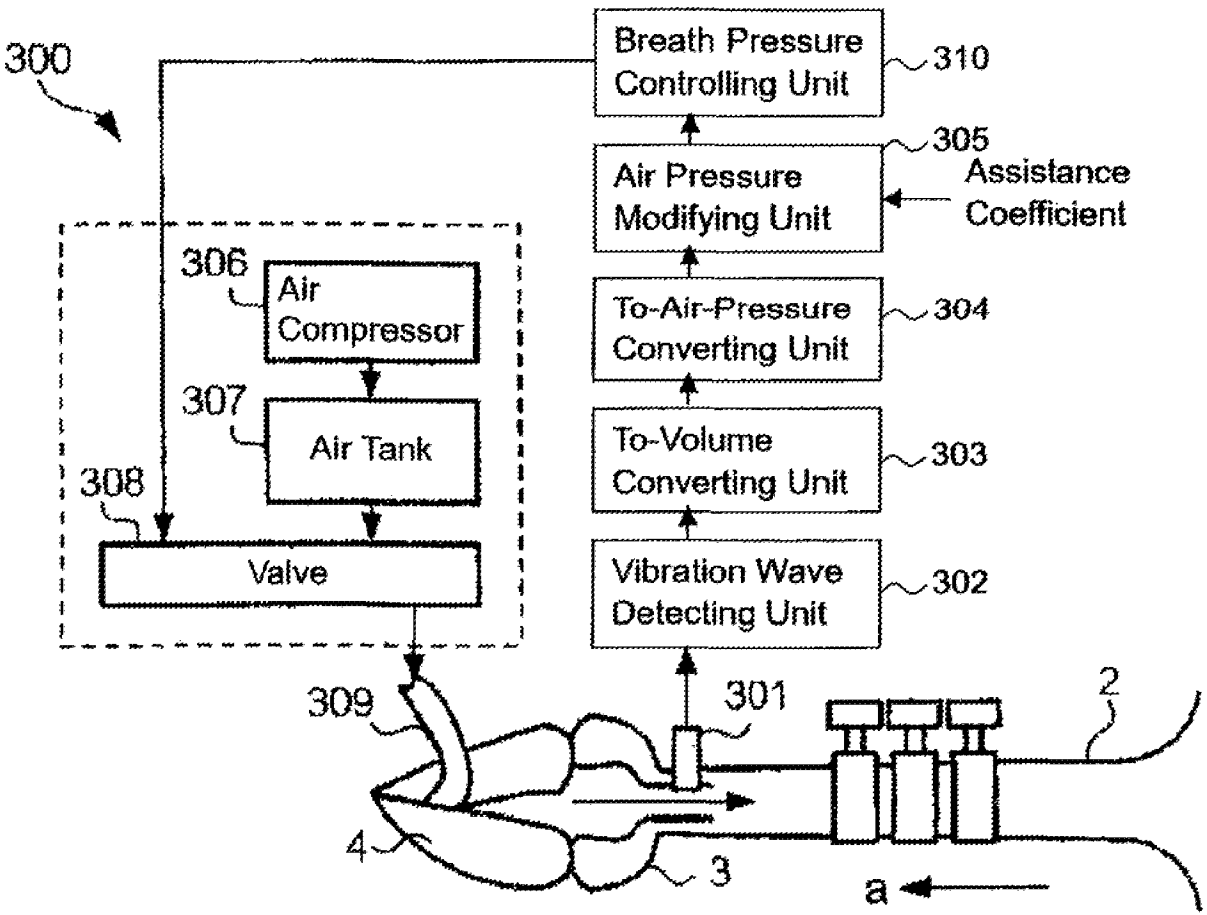
FIG. 5 is a block diagram illustrating the overall configuration of an apparatus for assisting in playing a musical instrument according to a third embodiment of the present invention.

Herein-below will be described a third embodiment of the present invention. FIG. 5 shows a block diagram illustrating the overall configuration of an apparatus for assisting in playing a musical instrument according to the third embodiment of the present invention, as is generally referenced by the numeral 300.

In FIG. 5, the numeral 301 denotes a microphone which picks up the sound in the mouthpiece 3 and generates a signal representing the vibration wave of the sound. The microphone is fixed to the mouthpiece 3 protruding in the bore. The numeral 302 denotes a vibration wave detecting unit which detects a vibration wave from the signal generated by the microphone 301. The numeral 303 denotes a to-volume converting unit which converts the vibration waveform detected by the vibration wave detecting unit 302 to tone volume data which represents the tone volume of the sound. The numeral 304 denotes a to-air-pressure converting unit which converts the tone volume data generated by the to-volume converting unit 303 to air pressure data which represents the air pressure of the sound.

The numeral 305 denotes an air pressure modifying unit comprised of the same electric circuit arrangement as the electric circuit (FIG. 2) of the embouchure modifying unit 14 of the first embodiment, and modifies the air pressure data in accordance with the recommended data and the assistance coefficient generates an air pressure assistance signal based on the recommended data Sb and the assistance coefficient r. The numeral 307 denotes an air tank. The numeral 306 denotes an air compressor which compresses the air to produce compressed air in the air tank 306. The numeral 309 denotes an air pipe for an air flow path of the compressed air produced by the air compressor 306. A valve 308 is provided at the connecting point of the air tank 307 and the air pipe 309. The numeral 310 denotes a breath pressure controlling unit which controls the valve 308 based on the air pressure assistance signal from the air pressure modifying unit 305 so that the flow rate of the air from the air tank 307 is controlled by the opening degree of the valve 308. The other end of the air pipe 309 is inserted in the mouth cavity of the player so that the air from the air tank 307 is delivered into the mouth cavity through the side of the player's lips 4.

Figure 6:
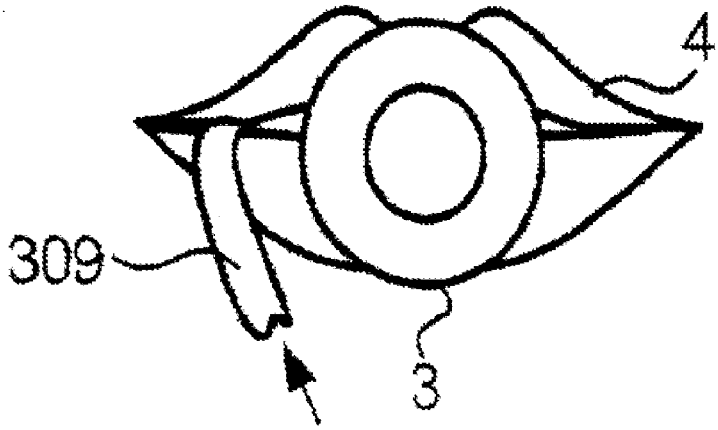
FIG. 6 is a front view around the mouthpiece and the lips in connection with the apparatus for assisting in playing a musical instrument shown in FIG. 5.

FIG. 6 shows a front view around the mouthpiece 3 and the lips 4 with the air pipe 309 as view in the direction of the arrow a FIG. 5.

The third embodiment of the above described arrangement will operate as follows. As the player presses his/her lips 4 against the mouthpiece 3 and forms a lip reed to blow air into the mouthpiece 3, the vibration wave generated in the mouthpiece 3 is picked up by the microphone 301. The signal outputted from the microphone 301 passes through the vibration wave detecting unit 302 and the to-volume converting unit 303 and is converted to the tone volume data, which in turn is converted to the air pressure data by the to-air-pressure converting unit 304. The air pressure modifying unit 305 then generates an air pressure assistance signal by incorporating the recommended data Sb in an amount corresponding to the assistance coefficient r. The breath pressure controlling unit 310 controls the valve 308 according to the air pressure assistance signal so that the compressed air flows into the mouth cavity of the player in a quantity determined by the air pressure assistance signal.

As the breath pressure in the player's mouth grows higher, the pressure difference between the air pressure in the mouth and the air pressure in the mouthpiece becomes larger, and hence the amount of air flowing out through the lips of the player increases. Thus, even when the actual breath pressure of the player is insufficient, the breath pressure will be increased so that the flow rate of the breath is increased to enable the player to blow the trumpet in a louder tone volume.

Fourth Embodiment

Figure 7:
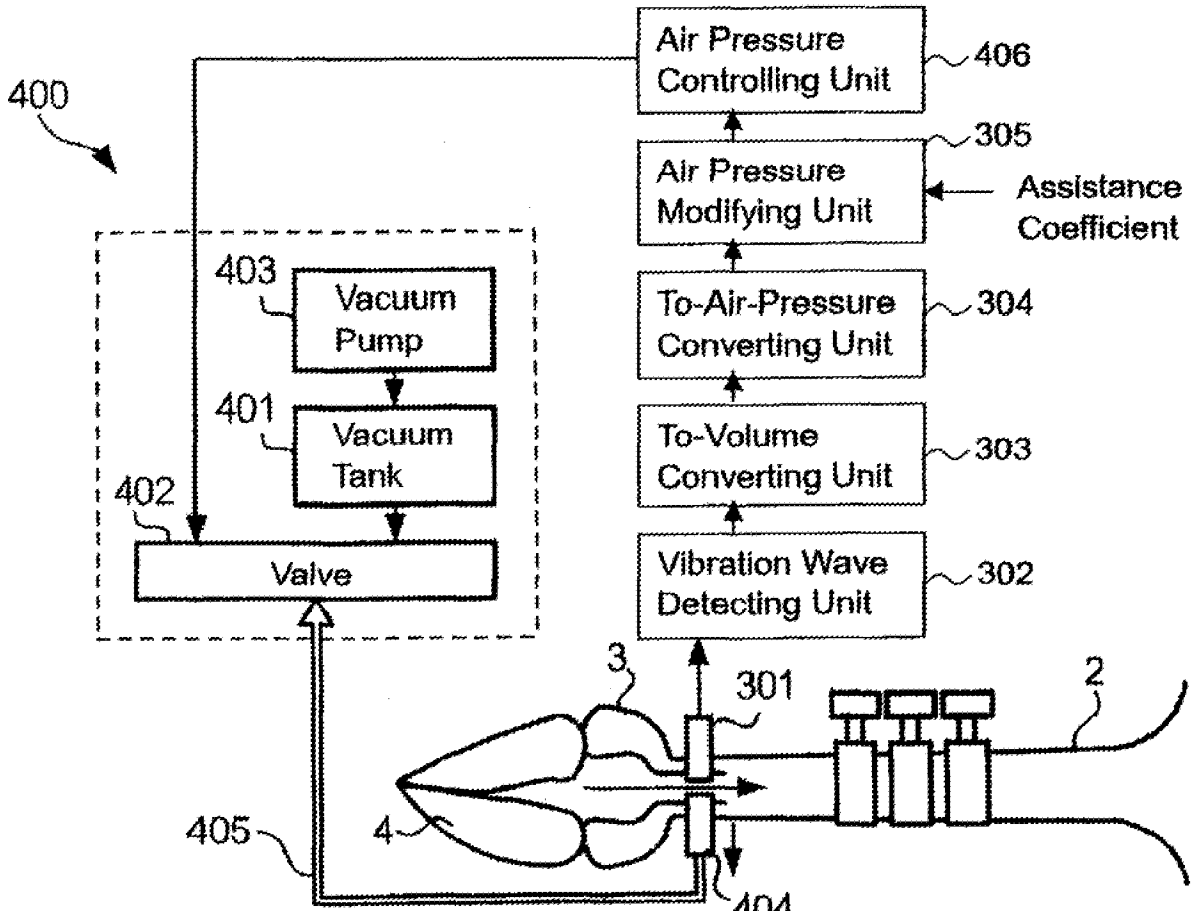
FIG. 7 is a block diagram illustrating the overall configuration of an apparatus for assisting in playing a musical instrument according to a fourth embodiment of the present invention.

Herein-below will be described a fourth embodiment of the present invention. FIG. 7 shows a block diagram illustrating the overall configuration of an apparatus for assisting in playing a musical instrument according to the fourth embodiment of the present invention, as is generally referenced by the numeral 400. The assisting apparatus 400 is different from the assisting apparatus 300 of the third embodiment in a few points and the remaining parts are the same as those in the third embodiment. In the following description, therefore, the explanation about the same or similar parts will be omitted by putting the same or similar reference numerals or symbols in FIG. 7 as those in the third embodiment. In FIG. 7, the numeral 401 denotes a vacuum tank to which is connected a valve 402. The numeral 403 denotes a vacuum pump which is connected to the vacuum tank 401 and evacuates the air in the vacuum tank 401. The numeral 404 denotes an air evacuation port provided on the lower tubular wall of the mouthpiece 3, and the air in the mouthpiece 3 will be evacuated through the evacuation port 404. The numeral 405 denotes an air pipe constituting an air flow path between the evacuation port 404 and the valve 402. The air evacuated through the evacuation port 404 will be sucked into the vacuum tank 401 through the air pipe 405. The numeral 406 denotes an air pressure controlling unit which controls the valve 402 based on the air pressure assistance signal supplied from the air pressure modifying unit 305 so that the flow rate of the air evacuated from the mouthpiece 3 is controlled by the valve 402.

The fourth embodiment of the above described arrangement will operate as follows. As the player presses his/her lips 4 against the mouthpiece 3 and blows air into the mouthpiece 3, the vibration wave generated in the mouthpiece 3 is picked up by the microphone 301. The signal outputted from the microphone 301 passes through the vibration wave detecting unit 302 and the to-volume converting unit 303 and is converted to the tone volume data, which in turn is converted to the air pressure data by the to-air-pressure converting unit 304. The air pressure modifying unit 305 then generates an air pressure assistance signal by incorporating the recommended data Sb in an amount corresponding to the assistance coefficient r. The air pressure controlling unit 406 controls the valve 402 according to the air pressure assistance signal so that the air in the mouthpiece 3 is evacuated in a quantity determined by the air pressure assistance signal.

As the air is evacuated from the mouthpiece 3, the pressure in the mouthpiece grows lower. The air pressure difference between the mouth cavity and the mouthpiece 3 will cause an air flow from the mouth to the mouthpiece. In this connection, even when the player himself/herself is blowing a little amount of air, a larger amount of air flows into the trumpet 2, which enables the player to blow the trumpet in a louder tone volume.

Fifth Embodiment

Figure 8:
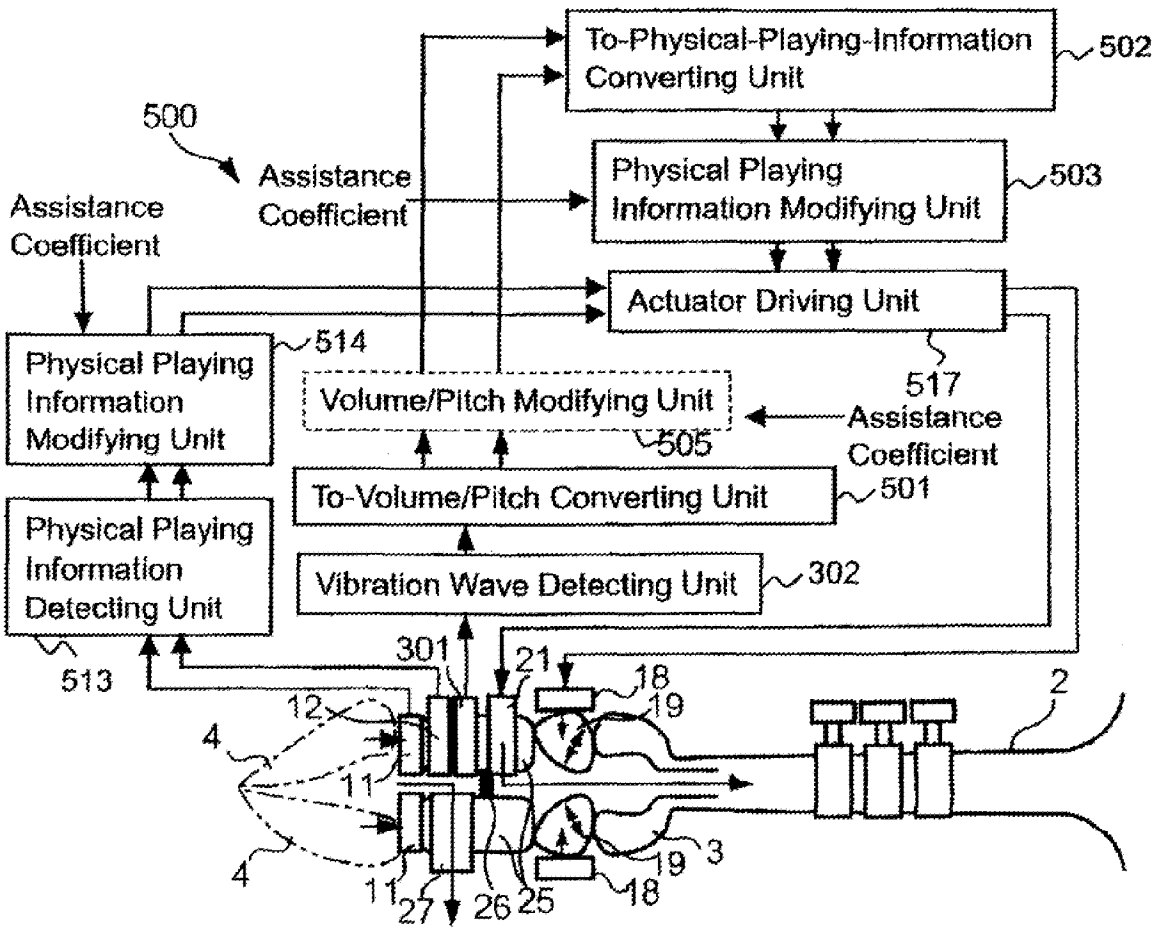
FIG. 8 is a block diagram illustrating the overall configuration of an apparatus for assisting in playing a musical instrument according to a fifth embodiment of the present invention.

Herein-below will be described a fifth embodiment of the present invention. FIG. 8 shows a block diagram illustrating the overall configuration of an apparatus for assisting in playing a musical instrument according to a fifth embodiment of the present invention, as is generally referenced by the numeral 500. The assisting apparatus 500 is different from the assisting apparatus 1 of the first embodiment in that the fifth embodiment detects a vibration waveform, computes (obtains) the tone volume and the pitch from the waveform data representing the vibration waveform, and drives the breath pressure actuator and the embouchure actuator based on those computed values, in addition to detecting and modifying the breath pressure and the embouchure. In FIG. 8, the elements which are respectively the same as those in the first or the third embodiment are given the same reference numerals or symbols, respectively, and the descriptions thereof will be omitted for the sake of brevity, where appropriate. In FIG. 8, the numeral 501 denotes a to-volume/pitch converting unit which converts the vibration waveform detected by the vibration wave detecting unit 302 to volume data representing the tone volume of the vibration wave and to pitch data representing the pitch of the vibration wave. The numeral 502 denotes a to-physical-playing-information converting unit which converts the volume data and the pitch data from the to-volume/pitch converting unit 501 to generate physical playing information including breath information and embouchure information. The numeral 502 denotes a physical playing information modifying unit which modifies the physical information generated by the to-physical-playing-information converting unit 502 in accordance with the assistance coefficient r. The physical playing information modifying unit 503 comprises the similar electric circuit as that shown in FIG. 2 in connection with the first embodiment, and modifies the physical playing information using the assistance coefficient r and the recommended data Sb.

The numeral 513 denotes a physical playing information detecting unit, which performs the functions of the embouchure detecting unit 13 and the breath pressure detecting unit 15 of the first embodiment shown in FIG. 1. The numeral 514 denotes a physical playing information modifying unit, which corresponds to the embouchure modifying unit 14 plus the breath pressure modifying unit 16. The numeral 517 denotes an actuator driving unit which drives the embouchure actuator 18 and the breath pressure actuator 21 based on the modified physical playing information, in which the embouchure actuator 18 and the breath pressure actuator 21 are designed to have actuating characteristics to operate adequately in response to the driving signals from the actuator driving unit 517.

The fifth embodiment of the above described arrangement will operate as follows. As the player presses his/her lips 4 against the embouchure detecting sensor 11 and forms a lip reed to blow air into the supporting member 25, the embouchure condition and the breath pressure are detected by the embouchure detecting sensor 11 and the breath pressure detecting sensor 12, respectively.

Additionally, the vibrating wave formed in the front bore of the supporting member 25 is picked up by the microphone 301, and the output of the microphone 301 is converted to the volume data and the pitch data through the vibration wave detecting unit 302 and the to-volume/pitch converting unit 501, which data are then converted to the physical playing information by the to-physical-playing-information converting unit 502. Then the physical playing information is modified by the physical playing information modifying unit 503 to make a physical playing assistance signal by incorporating the recommended data in an amount corresponding to the assistance coefficient r, while the physical playing information from the physical playing information detecting unit 513 is modified by the physical playing information modifying unit 514 to make a physical playing assistance signal by incorporating the recommended data in an amount corresponding to the assistance coefficient r. The actuator driving unit 517 drives the breath pressure actuator 21 and the embouchure actuator 18 based on the physical playing assistance signals. Thus, the compressed air flows into the mouthpiece 3 and then to the bore of the trumpet 2 in an amount corresponding to the breath pressure assistance signal, and the artificial lips 19 give an embouchure to the mouthpiece 3 for producing a tone by the trumpet 2.

With the above described configuration, the physical playing information obtained from the player's embouchure is modified directly and the modified physical information drives the breath pressure actuator 21 and the embouchure actuator 18. That is, the actuators are driven by the physical playing information directly. Consequently, there is no need of providing a wave generating circuit (e.g. an electronic tone generator) for generating a driving waveform to drive the breath pressure actuator 21 and the embouchure actuator 18.

Alternatively in FIG. 8, a volume/pitch modifying unit 505 (shown in broken lines) may be provided at the illustrated position in place of providing the physical playing information modifying unit 503. The volume/pitch modifying unit 505 is to modify the volume data and the pitch data generated by the to-volume/pitch converting unit 501. The volume/pitch modifying unit 504 has the same circuit configuration as that shown in FIG. 2 in connection with the first embodiment, and modifies the volume data and the pitch data by incorporating the recommended data Sb in an amount corresponding to the assistance coefficient r.

Sixth Embodiment

Figure 9:
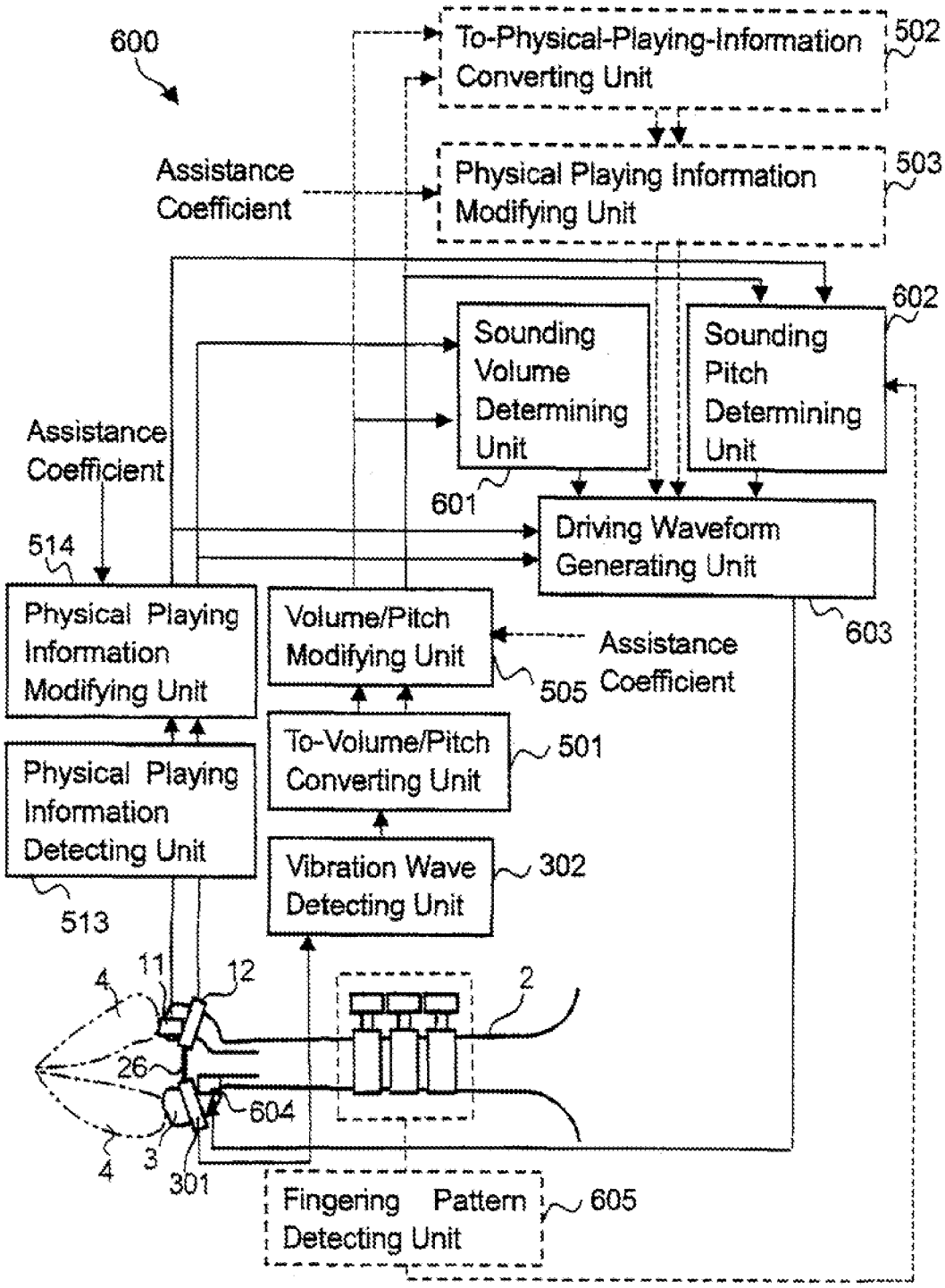
FIG. 9 is a block diagram illustrating the overall configuration of an apparatus for assisting in playing a musical instrument according to a sixth embodiment of the present invention.

Herein-below will be described a sixth embodiment of the present invention. FIG. 9 shows a block diagram illustrating the overall configuration of an apparatus for assisting in playing a musical instrument according to a sixth embodiment of the present invention, as is generally referenced by the numeral 600. The assisting apparatus 600 is different from the assisting apparatus 500 of the fifth embodiment in that the assisting apparatus 600 does not comprise an embouchure actuator and the breath pressure actuator, but comprises a vibratory actuator for generating vibration wave to assist in playing the trumpet 2. In the following description, therefore, the explanation will be devoted to the points different from the fifth embodiment and the explanation about the same or similar parts will be omitted by putting the same or similar reference numerals or symbols in FIG. 9 as those in the fifth embodiment for the sake of brevity.

In FIG. 9, the numeral 601 denotes a sounding volume determining unit which determines the volume of a tone to be produced based on the physical playing assistance signal from the physical playing information modifying unit 514 and the volume assistance signal from the volume/pitch modifying unit 505. The numeral 602 is a sounding pitch determining unit which determines the pitch of a tone to be produced based on the physical playing assistance signal from the physical playing information modifying unit 514 and the volume assistance signal from the volume/pitch modifying unit 505. The numeral 603 denotes a driving waveform generating unit which generates a driving waveform based on the sounding volume determined by the sounding volume determining unit 601 and the sounding pitch determined by the sounding pitch determining unit 602. The numeral 604 denotes a vibratory actuator for generating a vibration wave in the mouthpiece 3 under the control of the driving waveform generating unit 603. The driving waveform generating unit 603 is a so-called electronic tone generator which generates a waveform electronically, where the generated output waveform is a bit different from the audio waveform having the tone color of the trumpet, but is set to have such a waveform as will cause the trumpet to produce a high quality trumpet sound when the vibratory actuator 604 is driven by the driving waveform from the driving waveform generating unit 603. The driving waveform generating unit 603, therefore, stores a waveform which is a bit different from the waveform of the general trumpet sound.

The vibration that is emitted from the vibratory actuator 604 will finally be outputted as a sound from the bell of the trumpet 2, but it is a sound after the modification of the volume and the pitch played by the player as modified in accordance with the assistance coefficient.

While in the above described sixth embodiment, the breath pressure sensor 12 and the embouchure detecting sensor 11 detect the physical playing information and the microphone 301 detects the vibration wave so that the sounding volume and the sounding pitch are determined by using both the physical information and the vibration wave as so detected, the embodiment may be so designed that the sounding volume and the sounding pitch are determined either of the physical information and the vibration wave. More specifically, for example, the breath pressure sensor 12 and the embouchure detecting sensor 11 may be omitted and only the microphone 301 may be provided so that the sounding volume and the sounding pitch will be determined from only the vibration wave detected by the microphone 301.

Further, the sixth embodiment may be modified to comprise a to-physical-playing-information converting unit 502 and a physical playing information modifying unit 503 (as shown by broken lines in FIG. 9) in place of the sounding volume determining unit 601 and the sounding pitch determining unit 602 so that the volume assistance signal and the pitch assistance signal will be converted to the physical playing information, which in turn is supplied to the driving waveform generating unit 603. In such a case, the driving waveform generating unit 603 generates a driving waveform in response to the physical playing information supplied from the physical playing information modifying units 514 and 503 to drive the vibratory actuator 604.

Further, the sixth embodiment may be modified to further comprise a fingering pattern detecting unit 605 (as shown by broken lines in FIG. 9) so that the sounding pitch determining unit 602 will determine the sounding pitch from the sounding pattern information detected by the fingering pattern detecting unit 605. This will increase the tone quality and the pitch accuracy of the vibration waveform to be used by the actuator 604. Thus, this modified embodiment determines the sounding pitch by detecting the fingering pattern which is the manipulation condition of the trumpet 2 by means of the fingering pattern detecting unit 605 (i.e. a manipulation condition detecting sensor). Where the brass instrument can produce various different pitches with the same fingering pattern, the sounding pitch may preferably be determined by using both the fingering pattern and the physical playing information.

As the pitch of the lip reed vibration and the pitch of actuator vibration will be generally different and may cause an interference (i.e. amplitude modulation), the partition wall 26 is necessary to avoid such an interference. But if the player is to simply stiffens (tensions) his/her lips without vibrating the lip reed, the partition wall 26 would not be necessary. The vibration frequency of the lip reed may be of a pitch from among the discrete pitches in the equally tempered musical scale.

Seventh Embodiment

Figure 10:
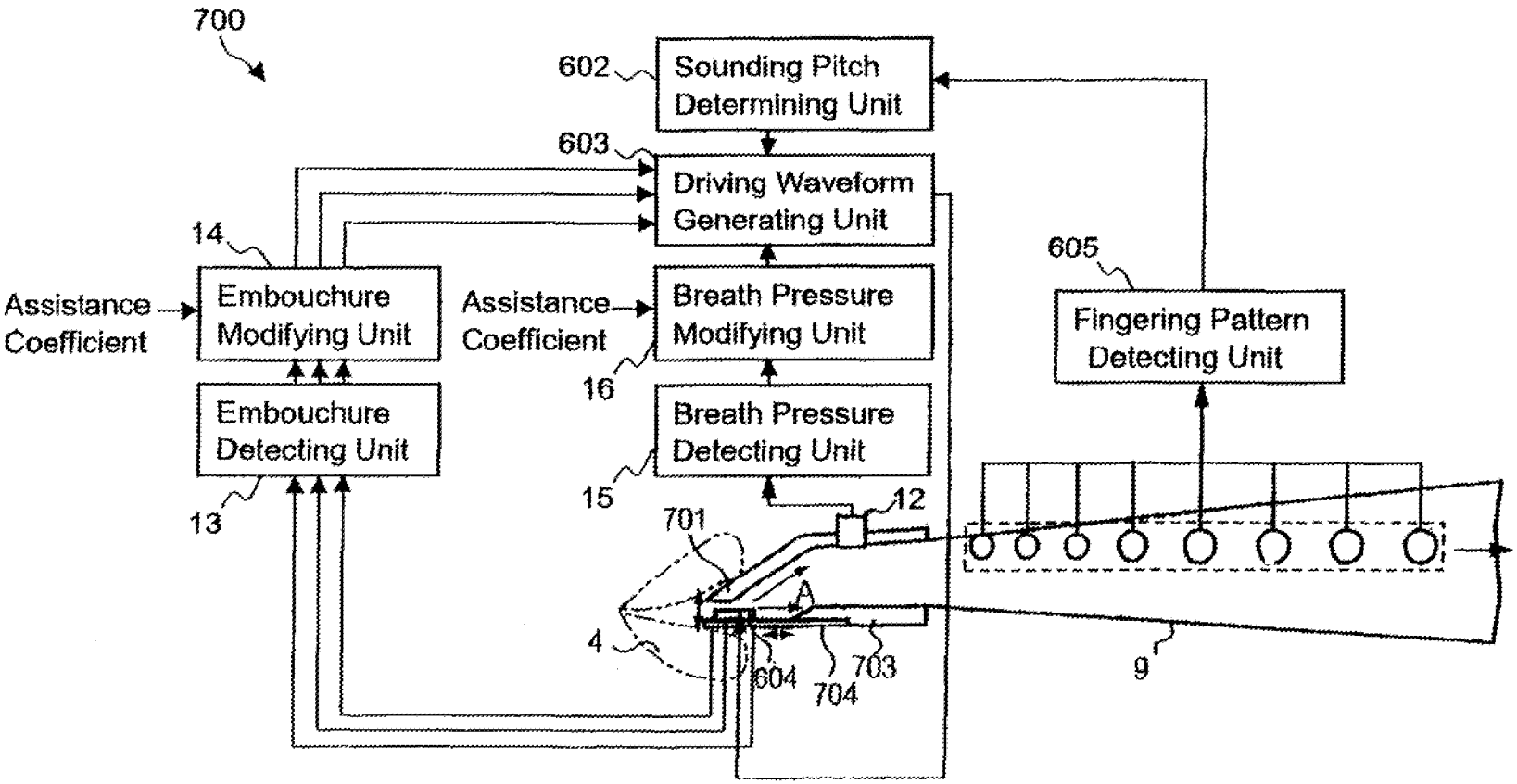
FIG. 10 is a block diagram illustrating the overall configuration of an apparatus for assisting in playing a musical instrument according to a seventh embodiment of the present invention.

Herein-below will be described a seventh embodiment of the present invention. FIG. 10 shows a block diagram illustrating the overall configuration of an apparatus for assisting in playing a musical instrument according to the seventh embodiment of the present invention, as is generally referenced by the numeral 700. The assisting apparatus 700 comprises several unit blocks which are common with those comprised in the heretofore described first through sixth embodiments, and such same blocks are referenced by the same numerals and unit names and detailed explanation will be omitted for the sake of brevity.

In FIG. 10, the numeral 9 denotes a woodwind instrument of a single reed type such as a clarinet and a saxophone and the numeral 4 denotes the lips of the player. The numeral 701 denotes a mouthpiece and the numeral 703 denotes a reed, to which are attached an embouchure detecting sensor 704. While the first through sixth embodiments detect the stiffness and the aperture of the lips as the embouchure conditions, the seventh embodiment with the woodwind instrument of a single reed type detects the displacement of the reed, the bite position of the reed and the contact area between the reed and the lower lip as the embouchure conditions.

The seventh embodiment of the above described arrangement will operate as follows. As the player bites the mouthpiece 701 and reed 703 with his/her lips 4 and blows air into the mouthpiece 3 fingering the keys for an intended note, the embouchure and the breath pressure are detected by the embouchure detecting sensor 704 and the breath detecting sensor 12, respectively. Then the breath pressure detecting unit 15 detects the breath pressure, and the breath pressure modifying unit 16 generates a breath pressure assistance signal by incorporating the recommended data Sb in an amount corresponding to the assistance coefficient r. On the other hand, the embouchure detecting unit 13 detects the embouchure conditions, and the embouchure modifying unit 14 generates the embouchure assistance signal by incorporating the recommended data Sb in amount corresponding to the assistance coefficient r. The fingering pattern detecting unit 605 detects the fingering condition of the player. The sounding pitch determining unit 602 determines the pitch of the sound to be produced in accordance with the detected fingering pattern. The driving waveform generating unit 603 generates a driving waveform based on the breath pressure assistance signal, the embouchure assistance signal and the sounding pitch so that the driving waveform drives the vibratory actuator 604 to cause a vibration, which in turn is resonated in the wind instrument 9 to produce an intended instrument tone. Thus, the volume and the pitch of the tone played by the player will be modified in accordance with the assistance coefficient.

In the case of the single reed woodwind instrument, the pitches of the produced tones are usually determined uniquely according to the fingering patterns, other than in the case of the flageolet performance. The seventh embodiment, accordingly, provides an assisting apparatus by making good use of such a nature of the woodwind instrument. In order to be as close as possible to the waveform of the sounding wave just beneath the reed or in the mouthpiece, the driving waveform is generated based on the embouchure and the breath pressure. By generating the driving waveform in the shape of the vibration waveform of the reed or the sound pressure waveform just beneath the mouthpiece, and driving the vibratory actuator arranged on the reed or driving a small loudspeaker arranged in the mouthpiece, musical instrument sounds which are very close to the naturally played sounds will come out from the tone holes or the bell of the woodwind instrument.

Eighth Embodiment

Figure 11:
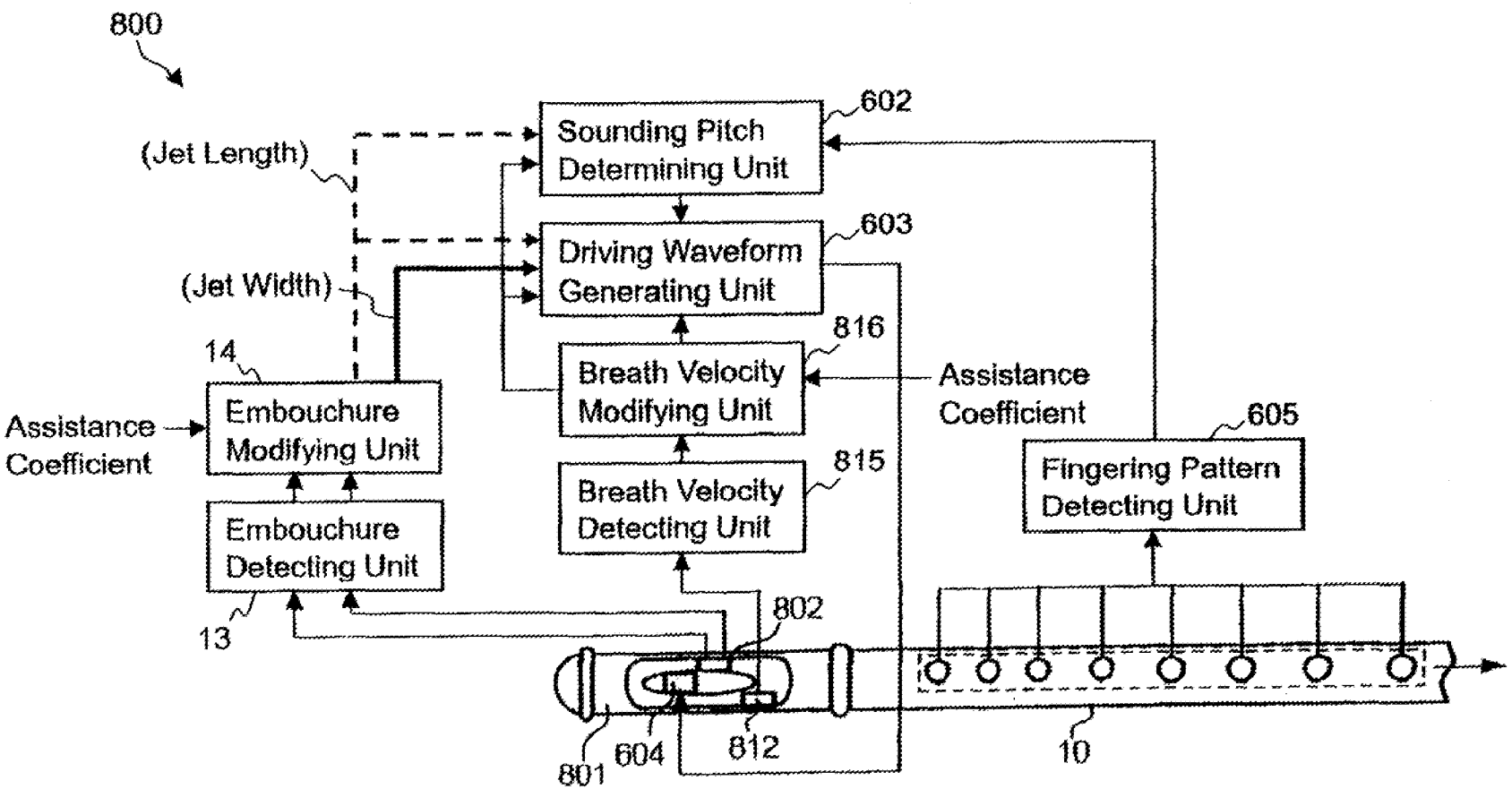
FIG. 11 is a block diagram illustrating the overall configuration of an apparatus for assisting in playing a musical instrument according to an eighth embodiment of the present invention.

Herein-below will be described an eighth embodiment of the present invention. FIG. 11 shows a block diagram illustrating the overall configuration of an apparatus for assisting in playing a musical instrument according to the eighth embodiment of the present invention, as is generally referenced by the numeral 800. In FIG. 11, the structural elements which are the same as the elements in the seventh embodiment are given the same reference numerals and names, respectively, and detailed explanation will be omitted for the sake of brevity.

In FIG. 11, the numeral 10 denotes a woodwind instrument of an air reed type such as a flute and a recorder. The numeral 801 denotes a mouthpiece, to which is attached an embouchure detecting sensor 802 which detects the jet length and the jet width of the air flow caused by the player playing the instrument.

The numeral 812 denotes a breath velocity detecting sensor which detects the velocity of the breath (i.e. the air flow) of the player and generates a signal representing the velocity. The numeral 815 denotes a breath velocity detecting unit which generates a breath velocity information signal based on the signal from the breath velocity detecting sensor 812. The numeral 816 denotes a breath velocity modifying unit which modifies the breath velocity information supplied from the breath velocity detecting unit 815 to generate a breath velocity assistance signal. The electric circuit configuration of the breath velocity modifying unit 816 and its method of generating the breath velocity assistance signal are the same as those of the embouchure modifying unit 14 of the first embodiment shown in FIG. 2, and detailed explanation thereof is omitted here for the sake of brevity.

With the eighth embodiment of the above described configuration, the sounding pitch determining unit 602 determines the pitch of the tone to be sounded based on the modified embouchure assistance signal (the jet length) and the breath velocity assistance signal, and the driving waveform generating unit 603 generates a driving waveform for the actuator 604 based on the pitch determined by the sounding pitch determining unit 602, the breath velocity assistance signal, and the embouchure assistance signal (the jet width and the jet length). In the case of the woodwind instrument of the air reed type, the pitch of the tone to be sounded will not be uniquely determined by the fingering pattern alone, like in the case of the brass instrument, but will be determined by the combination of the fingering pattern, the breath velocity and the player's embouchure. The eighth embodiment is to assist the player in playing the air reed type woodwind instrument, making good use of such a nature.

Ninth Embodiment

Figure 12:
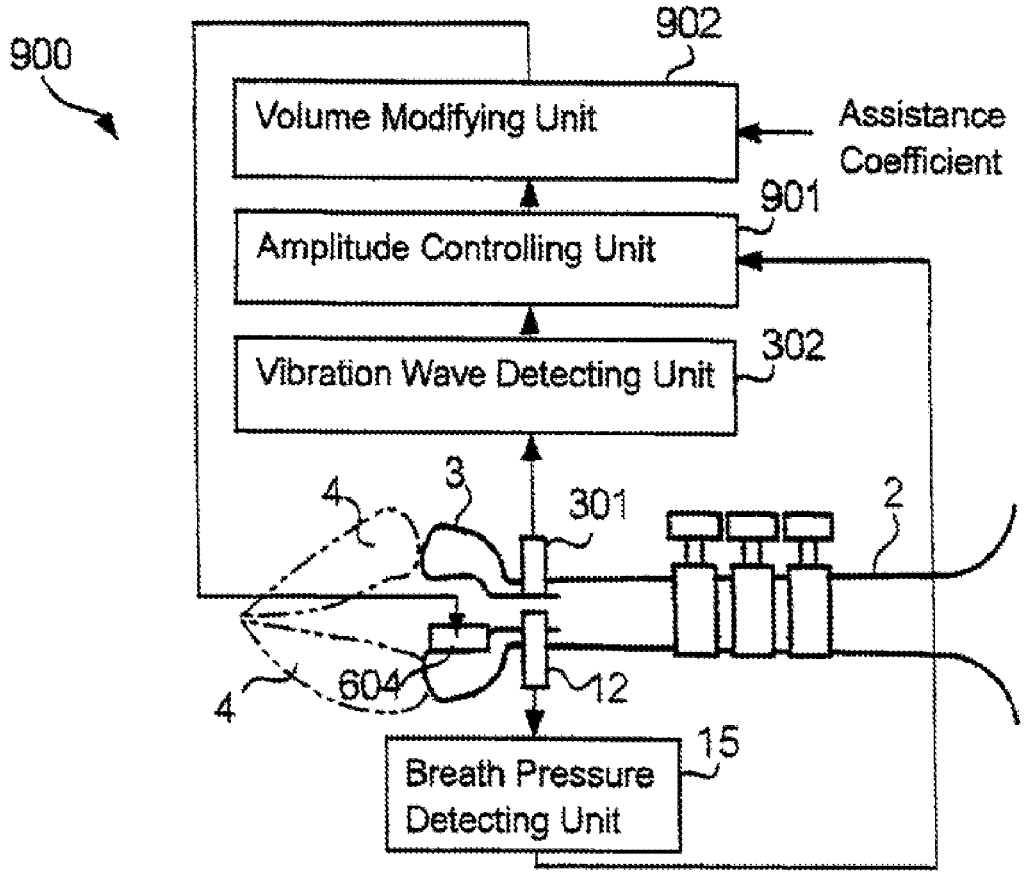
FIG. 12 is a block diagram illustrating the overall configuration of an apparatus for assisting in playing a musical instrument according to a ninth embodiment of the present invention.

Herein-below will be described a ninth embodiment of the present invention. FIG. 12 shows a block diagram illustrating the overall configuration of an apparatus for assisting in playing a musical instrument according to the ninth embodiment of the present invention, as is generally referenced by the numeral 900. In FIG. 12, the structural elements which are the same as the elements in the first through sixth embodiment are given the same reference numerals and names, respectively, and detailed explanation will be omitted for the sake of brevity.

In FIG. 12, the numeral 901 denotes an amplitude controlling unit which simply limits the amplitude of the vibration waveform according to the breath pressure supplied from the breath pressure detecting unit 15. Where the actuator 604 is driven by the vibration wave, the vibration caused by the actuator 604 will be picked up by the microphone 301, thereby establishing a feedback loop for the vibration. Depending on the loop gain of this feedback loop, a howling phenomenon may occur. In order to prevent such a phenomenon from occurring, the breath pressure which is a value related to the tone volume is detected by the breath pressure detecting unit 15 so that the amplitude of the vibration wave from the vibration wave detecting unit 302 is limited in accordance with the value which corresponds to the breath pressure. The numeral 902 denotes a volume modifying unit which modifies the vibration wave signal supplied from the amplitude controlling unit 901 in accordance with the assistance coefficient. In the illustrated embodiment, the vibration wave itself which is picked up by the microphone 301 is processed through the signal processing units 302, 901 and 902 and is given to the vibratory actuator 604 to generate a sound vibration.

Tenth Embodiment

Figure 13:
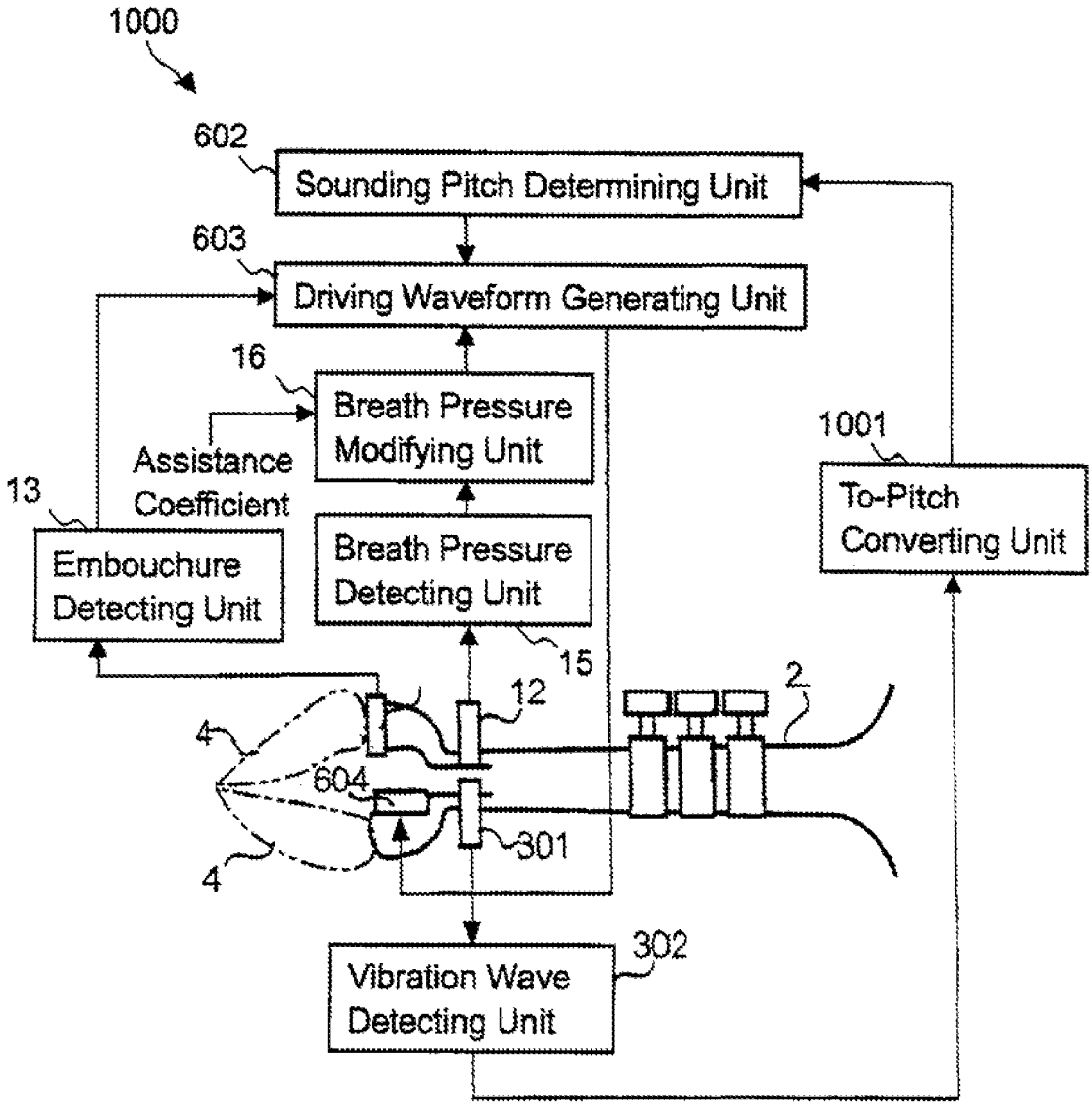
FIG. 13 is a block diagram illustrating the overall configuration of an apparatus for assisting in playing a musical instrument according to a tenth embodiment of the present invention.

Herein-below will be described a tenth embodiment of the present invention. FIG. 13 shows a block diagram illustrating the overall configuration of an apparatus for assisting in playing a musical instrument according to the tenth embodiment of the present invention, as is generally referenced by the numeral 1000. In FIG. 13, the structural elements which are the same as the elements in the first through sixth embodiment are given the same reference numerals and names, respectively, and detailed explanation will be omitted for the sake of brevity.

In FIG. 12, the numeral 1001 denotes a to-pitch converting unit which generates a pitch data signal representing the pitch of the vibration wave from the vibration waveform detected by the vibration wave detecting unit 302. With the tenth embodiment, the vibration wave in the mouthpiece 3 is detected by the vibration wave detecting unit 302, the pitch of the vibration wave is detected by the to-pitch converting unit and the pitch of the driving wave is determined by the sounding pitch determining unit 602 on one hand, and the breath pressure is detected by the breath pressure sensor 12, the breath pressure data signal is modified in accordance with the assistance coefficient by the breath pressure modifying unit 16 to generate the breath pressure assistance signal, the actuator driving waveform is generated based on the breath pressure assistance signal from the breath pressure modifying unit 16, the sounding pitch from the sounding pitch determining unit 602 and the embouchure from the embouchure detecting unit 13, and the actuator driving waveform is given to the vibratory actuator 604 to generate a sound vibration. This embodiment enables the assistance in terms of the pitch.

Additional Improvements and Alterations

While various embodiments have been described hereinabove, the present invention can be practiced with further improvements or alterations as will be explained in connection with several examples below.

(1) While the above described second embodiment is to assist the player in playing the musical instrument using the playing information of a second player such as a model player, the information which can be used for assisting in playing the musical instrument is not limited to such playing information of the second player. For example, as shown in FIG. 14, a camera 250 may be provided on the trumpet 2 or on the assisting apparatus to recognize the body movement of a conductor S1 or the movement of a baton S2, extract the velocity, the direction, the timing, etc. of the movement, and generate therefrom the breath pressure signal and the embouchure signal to be the elements of a model playing, which in turn are supplied to the breath pressure modifying unit 216 and the embouchure modifying unit 214. Alternatively, an acceleration sensor, a velocity sensor, a direction sensor, etc. may be built in the baton S2 so that the output from these sensors may be used to generate the model data for the embouchure and/or the breath pressure. Further, the instrument with which the model playing is given may be different from the instrument with which the assisting apparatus assists the player in playing. For example, when the assisting apparatus assists the player in playing the trumpet, the model playing data may be prepared using a keyboard musical instrument. For example, the model playing data for the embouchure and the breath pressure can be generated based on the key depression time points, the key release time points, the key depression velocities, the key release velocities, the key depression accelerations, or else.

(2) While the above described embodiments comprise the modifying circuits having the circuit configuration as shown in FIG. 2 to generate the assistance signals using the recommended data. Sb and the assistance coefficient r, the circuit configuration for generating the assistance signal may not be limited to the circuit of FIG. 2. For example, the circuit as shown in FIG. 15 may be employed in which the recommended playing data is passed through a high-pass filter before entering the multiplier. With this configuration, the differential of the recommended playing data has a great influence on the detected playing data so that, for example, the detected playing data (the data to be assisted) will be influenced greatly at build-up portions and build-down portions in the progression of the music playing. Alternatively, the circuit as shown in FIG. 16 may be employed in which the recommended playing data is passed first through a low-pass filter and next through a high-pass filter before entering the multiplier. With this configuration, the low-pass filter suppresses the rapid changes at build-up portions and build-down portions of the recommended data and presents the rough changes, and the high-pass filter then emphasizes the ascending portions and the descending portions in the rough changes so that the thus characterized recommended data will have an influence on the detected playing data.

Further alternatively, the circuit as shown in FIG. 17 may be employed. This configuration comprises two separate modifying channel each having a database of the recommended data and a modifying circuit for two separate physical playing information signals, respectively. The database DB1 is for the processing of the first physical playing information and the database DB2 is for the processing of the second physical playing information. The block A1 determines a sounding pitch of the tone to be played based on the detected playing data including the fingering pattern data, the first physical playing information and the second physical playing information. The fingering pattern data may not be necessarily included depending on the situation. The first physical playing information and the second physical playing information are different information from each other, for example, like the embouchure information and the breath pressure information. The playing data modifying units C1 and C2 each have the same circuit structure as the circuit shown in FIG. 2 for conducting a linear interpolation arithmetic operation corresponding to the assistance coefficient r to modify each (first or second) physical playing information. The arithmetic operation using the assistance coefficient r may not necessarily be a linear interpolation operation as described above in the various embodiments. Other kinds of arithmetic operation may be used. The point is that the degree of influence by the recommended data on the detected player's data is to be selectively varied according to the value of the assistance coefficient r.

(3) The above descriptions about the present invention have been focused on the embodiments for assisting the player in playing the wind musical instruments, but it should be understood that the present invention can also be applied to the assistance for other types of musical instruments.

For example, with the keyboard musical instrument, the strength of a key depression is to be detected, the detected key depression data is modified with reference to the recommended key depression data to generate a key depression assistance signal, which assistance signal in turn drives a key actuating solenoid to depress the key thereby assisting the player's key depression. Such a configuration can easily be practiced in the case of a player piano which inherently comprises solenoids to actuate the keys. An assistance may be for the pedals using solenoids therefor. Further, the actuators may be attached to the body (e.g. the wrist) of the player to assist the movements of the hands or the fingers of the player. The assistance is given by driving the actuator in the direction in which the finger moves. In other words, the actuators are attached to the body parts with which the player plays the instrument and the actuators will be controlled, based on the play assistance signal, to increase the manipulating forces of such body parts in the directions to play the instrument.

(4) For assisting the player with the rubbed string musical instrument such as a violin, the rubbed string instrument is to be provided with actuators for pressing the strings at the respective note positions against the finger board and with a bowing mechanism, while another rubbed string instrument is provided with sensors to detect the player's finger pressures and bowing movements to generate the assistance signals, which in turn will drive the string pressing actuators and the bowing mechanism. Likewise with the plucked string musical instrument such as a guitar, the plucked string instrument is to be provided with actuators for pressing the strings at the respective note positions against the finger board and with a plucking mechanism, while another plucked string instrument is provided with sensors to detect the player's finger pressures and plucking movements (of the right fingers or the pick) to generate the assistance signals, which in turn will drive the string pressing actuators and the plucking mechanism.

(5) In the above described embodiments, the quantities of various manipulations by the player applied against the musical instrument for playing the same are detected and corrected (enhanced or improved) and the corrected manipulations are exerted on the instrument, thereby assisting the player in playing the instrument. The examples of the quantities of manipulations are the values of the stiffness and the apertures of the player's lips, which values are detected and used to generate the embouchure data (or signal), and further the values of the breath pressure, the fingering pattern, the breath velocity, the vibration waveform, the key depression strength, which values are detected and used to generate the physical playing information. Further, the movements of a conductor are analyzed to extract the beat time points and the characteristic moves, which are converted to the durations of the notes, variation of the dynamics, variation in the pitches, etc. which are in turn converted to the embouchure data and the breath pressure for controlling actuators of the assisting apparatus. Still further, the bowing speed and angle, and the tension of the bow hair are detected to be used as the manipulation quantities. Thus, the quantities of manipulations by the player are the values defining the amount of the parameters for playing the instrument, and therefore, it should be understood that various detected values can be the quantities of manipulations depending on the character of the instrument. For example, the vibration frequency of the player's lips can be detected as a quantity of manipulation, and further the displacement of the reed, the bite position of the reed and the contact area between the reed and the lip may be detected as quantities of manipulation and may be converted to the embouchure data.

While particular embodiments of the invention and particular modifications have been described, it should be expressly understood by those skilled in the art that the illustrated embodiments are just for preferable examples and that various modifications and substitutions may be made without departing from the spirit of the present invention so that the invention is not limited thereto, since further modifications may be made by those skilled in the art, particularly in light of the foregoing teachings.

It is therefore contemplated by the appended claims to cover any such modifications that incorporate those features of these improvements in the true spirit and scope of the invention.

What is claimed is:

1. An apparatus for assisting in playing a musical instrument comprising:

a manipulation quantity detecting device for detecting a quantity of manipulation by a player against a musical instrument for playing said musical instrument;

an assistance signal generating device for generating an assistance signal which represents a degree of assistance in playing said musical instrument by processing said detected quantity of manipulation according to a given assistance coefficient; and an actuating device adapted to be coupled to said musical instrument for actuating said musical instrument based on said assistance signal;

wherein said musical instrument is a brass instrument having a mouthpiece; and wherein said actuating device includes artificial lips having a plurality of elastic members covering said mouthpiece, an actuator for actuating said artificial lips based on said assistance signal to establish an embouchure for playing said brass instrument and a gas blowing mechanism for blowing compressed gas into said mouthpiece through said artificial lips, wherein said artificial lips and said gas blowing mechanism are controlled based on said assistance signal to determine an amount of said blown compressed gas.

2. An apparatus as claimed in claim 1, wherein said manipulation quantity detecting device includes a sensor attached to said mouthpiece to which the player presses his/her lips and blows in a breath, said sensor detects an embouchure of said player against said mouthpiece, and said quantity of manipulation includes said embouchure.

3. An apparatus as claimed in claim 1 or 2, wherein said manipulation quantity detecting device includes a breath pressure sensor attached to said mouthpiece to which the player presses his/her lips and blows in a breath, said sensor detects a breath pressure of said player, and said quantity of manipulation includes said breath pressure.

4. An apparatus as claimed in any of claims 1-2, wherein said actuating device includes a vibrator attached to said mouthpiece and driven by said assistance signal.

5. An apparatus as claimed in claim 1, wherein said manipulation quantity detecting device is a first manipulation quantity detecting device, and said apparatus further comprising:

a second manipulation quantity detecting device for detecting a quantity of manipulation by a second player against a second musical instrument for playing said second musical instrument; and wherein said assistance signal generating device for generating said assistance signal by processing the quantity of manipulation detected by said first manipulation quantity detecting device and the quantity of manipulation detected by said second manipulation quantity detecting device respectively according to respectively given assistance coefficients.

6. An apparatus as claimed in claim 1, further comprising:

a manipulation condition detecting sensor for detecting conditions of manipulating elements of said musical instrument; and a pitch determining device which determines a sounding pitch of said musical instrument based on said detected conditions of the manipulating elements; and wherein said actuating device actuates said musical instrument based on said assistance signal and said determined sounding pitch.

7. An apparatus as claimed in claim 1, wherein the assistance signal generating device generates the assistance signal by processing said detected quantity of manipulation and recommended data.

* * * * *